US007950652B2

(12) United States Patent
Terao et al.

(10) Patent No.: US 7,950,652 B2
(45) Date of Patent: May 31, 2011

(54) SHEET DISCHARGE APPARATUS, IMAGE FORMING APPARATUS AND SHEET DISCHARGING METHOD

(75) Inventors: Yasunobu Terao, Shizuoka-ken (JP); Yoshiaki Sugizaki, Shizuoka-ken (JP); Hiromasa Harashina, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 196 days.

(21) Appl. No.: 12/137,942

(22) Filed: Jun. 12, 2008

(65) Prior Publication Data

US 2008/0315504 A1 Dec. 25, 2008

Related U.S. Application Data

(60) Provisional application No. 60/944,928, filed on Jun. 19, 2007, provisional application No. 60/944,931, filed on Jun. 19, 2007.

(30) Foreign Application Priority Data

Apr. 22, 2008 (JP) ..... 2008-111042

(51) Int. Cl.
*B65H 31/26* (2006.01)

(52) U.S. Cl. ..... 271/220; 271/189; 271/218; 271/207

(58) Field of Classification Search ..... 271/220, 271/207, 189, 218
See application file for complete search history.

(56) References Cited

U.S. PATENT DOCUMENTS

| | | | | |
|---|---|---|---|---|
| 4,197,045 | A * | 4/1980 | Stauber | 414/788.2 |
| 4,577,853 | A * | 3/1986 | Duke | 271/217 |
| 4,611,800 | A * | 9/1986 | Parsons et al. | 271/3.04 |
| 5,002,456 | A * | 3/1991 | Gosslinghoff | 414/788.3 |
| 5,713,283 | A * | 2/1998 | Eltner et al. | 101/232 |
| 5,725,207 | A | 3/1998 | Deguchi | |
| 6,026,273 | A | 2/2000 | Kinouchi et al. | |
| 6,078,781 | A | 6/2000 | Takagi et al. | |
| 6,087,641 | A | 7/2000 | Kinouchi et al. | |
| 6,196,542 | B1 * | 3/2001 | Allmendinger | 271/189 |
| 6,607,194 | B2 * | 8/2003 | Moeller et al. | 271/220 |
| 6,725,000 | B2 | 4/2004 | Takagi et al. | |
| 6,843,476 | B2 * | 1/2005 | Schuller et al. | 271/207 |
| 6,861,630 | B2 | 3/2005 | Kinouchi et al. | |
| 6,900,419 | B2 | 5/2005 | Takagi et al. | |
| 7,007,946 | B1 * | 3/2006 | Dobrindt et al. | 271/189 |
| 7,007,948 | B2 * | 3/2006 | Kamiya et al. | 271/221 |
| 7,065,315 | B2 | 6/2006 | Kinouchi et al. | |
| 7,184,697 | B2 | 2/2007 | Kinouchi et al. | |
| 7,305,197 | B2 | 12/2007 | Kinouchi et al. | |
| 2006/0066033 | A1 | 3/2006 | Terao et al. | |

(Continued)

FOREIGN PATENT DOCUMENTS

JP 11-327331 11/1999

(Continued)

*Primary Examiner* — Stefanos Karmis
*Assistant Examiner* — Luis A Gonzalez
(74) *Attorney, Agent, or Firm* — Turocy & Watson, LLP

(57) ABSTRACT

A sheet discharge apparatus includes a discharge portion configured to discharge sheets, a wall member provided below the discharge portion, a tray configured to receive the discharged sheets from the discharge portion, and a holding member provided on the wall member to approach relatively the tray, holding the sheets between itself and the tray, and moving linearly by holding the sheets.

12 Claims, 21 Drawing Sheets

U.S. PATENT DOCUMENTS

| | | | |
|---|---|---|---|
| 2006/0066831 | A1 | 3/2006 | Terao et al. |
| 2007/0063413 | A1 | 3/2007 | Terao et al. |
| 2007/0212091 | A1 | 9/2007 | Kinouchi et al. |
| 2007/0252320 | A1 | 11/2007 | Terao et al. |
| 2008/0315494 | A1 | 12/2008 | Terao et al. |
| 2008/0315505 | A1 | 12/2008 | Terao et al. |
| 2008/0315506 | A1 | 12/2008 | Terao et al. |

FOREIGN PATENT DOCUMENTS

| | | |
|---|---|---|
| JP | 2000-250338 | 9/2000 |
| JP | 2001-125407 | 5/2001 |
| JP | 2001-315993 | 11/2001 |
| JP | 2004-151470 | 5/2004 |
| JP | 2004-284773 | 10/2004 |
| JP | 2004-331369 | 11/2004 |

* cited by examiner

SHEET DISCHARGE APPARATUS, IMAGE FORMING APPARATUS AND SHEET DISCHARGING METHOD

CROSS-REFERENCE TO RELATED APPLICATION

This application is based upon and claims the benefit of priority from the prior U.S. Patent Application No. 60/944,928, filed on Jun. 19, 2007; the entire contents of all of which are incorporated herein by reference.

This application is based upon and claims the benefit of priority from the prior U.S. Patent Application No. 60/944,931, filed on Jun. 19, 2007; the entire contents of all of which are incorporated herein by reference.

This application is based upon and claims the benefit of priority from the prior Japanese Patent Application No. 2008-111042, filed on Apr. 22, 2008; the entire contents of all of which are incorporated herein by reference.

FIELD OF THE INVENTION

The present invention relates to a sheet discharge apparatus, an image forming apparatus and a sheet discharging method and more particularly to a sheet discharge apparatus having a movable receiving tray.

DESCRIPTION OF THE BACKGROUND

In recent years, many image forming apparatuses mounted with a plurality of receiving trays for loading sheets with an image formed by an image forming portion are manufactured so as to be able to separate and discharge the sheets for each job. In such a plurality of receiving trays, for example, as in the sheet discharge apparatus disclosed in Japanese Patent Application Publication No. 2004-284773, at least one receiving tray may be of a movable type. By doing this, the amount of storage and discharge sheets can be increased.

In a sheet discharge apparatus having such a movable receiving tray, when sheets are discharged to the receiving tray, the end of each discharged sheet slides in contact with the top of the sheet discharged already on the receiving tray. Therefore, due to the contact-sliding, the already-discharged sheet moves, thus a problem arises that sheets cannot be stacked in array on the receiving tray. Particularly, in a stapled sheet bundle, the stapled portion is projected, so that those portions interfere with each other. Therefore, whenever a succeeding sheet bundle is discharged, the discharged sheet bundle is pressed out from the receiving tray, thus the stacking in array is disturbed.

On the other hand, in the aforementioned sheet discharge apparatus disclosed in Japanese Patent Application Publication No. 2004-284773, in order to stack discharged sheets in array, at the base end of the movable receiving tray, a plurality of holding members for holding the back-end portion of the discharged sheets are installed. The holding members are installed on the rotary shaft rotating for driving which is directed in the perpendicular direction to the sheet discharge direction. When the rotary shaft rotates for driving, the holding members also rotate and hold the back-end portion of the sheets.

However, in the aforementioned constitution, the holding members are installed on the rotary shaft, so that the holding operation is limited to the neighborhood of the position of the rotary shaft and when the height of the movable receiving tray at the time of standby is different for each job, it is difficult to perform the holding operation. Furthermore, a driving apparatus for driving the rotary shaft is necessary, so that in the respects that the structure of the sheet holding mechanism is complicated and the cost of the apparatus is increased, there is a room for improvement left.

Further, the holding members rotating to hold sheets change the rotational angle due to the height of the uppermost sheet. When the sheets are high and the rotational angle is small, there is a fear that the sheet holding surfaces of the holding members may hit on the sheets so as to press them out.

SUMMARY OF THE INVENTION

The present invention was developed with the foregoing in view and is intended to provide a sheet discharging method for realizing sheet holding in a brief structure without depending on the tray height at the time of standby, a sheet discharge apparatus, and an image forming apparatus including it.

To accomplish the above object, an embodiment of the present invention provides a sheet discharge apparatus comprising a discharge portion configured to discharge sheets; a wall member provided below the discharge portion; a tray configured to receive the discharged sheets from the discharge portion; and a holding member provided on the wall member to approach relatively the tray, holding the sheets between itself and the tray, and moving linearly by holding the sheets.

Furthermore, an embodiment of the present invention provides an image forming apparatus comprising a sheet storage portion configured to store sheets; an image forming portion configured to form an image on the sheets conveyed from the sheet storage portion; a discharge portion configured to discharge the sheets with the image formed from a discharge spout; a wall member provided below the discharge portion; a tray configured to receive the discharged sheets from the discharge portion; and a holding member provided on the wall member to approach relatively the tray, holding the sheets between itself and the stray, and moving linearly by holding the sheets.

Furthermore, an embodiment of the present invention provides a sheet discharging method comprising discharging sheets from a discharge spout; receiving the discharged sheets by a tray; sliding down the received sheets to a wall member provided below the discharge spout; and permitting a holding member provided on the wall member to approach relatively the tray and permitting the holding member and the tray surface to hold the sheets and linearly move by holding the sheets.

DETAILED DESCRIPTION OF THE INVENTION

First Embodiment

Figure 1:
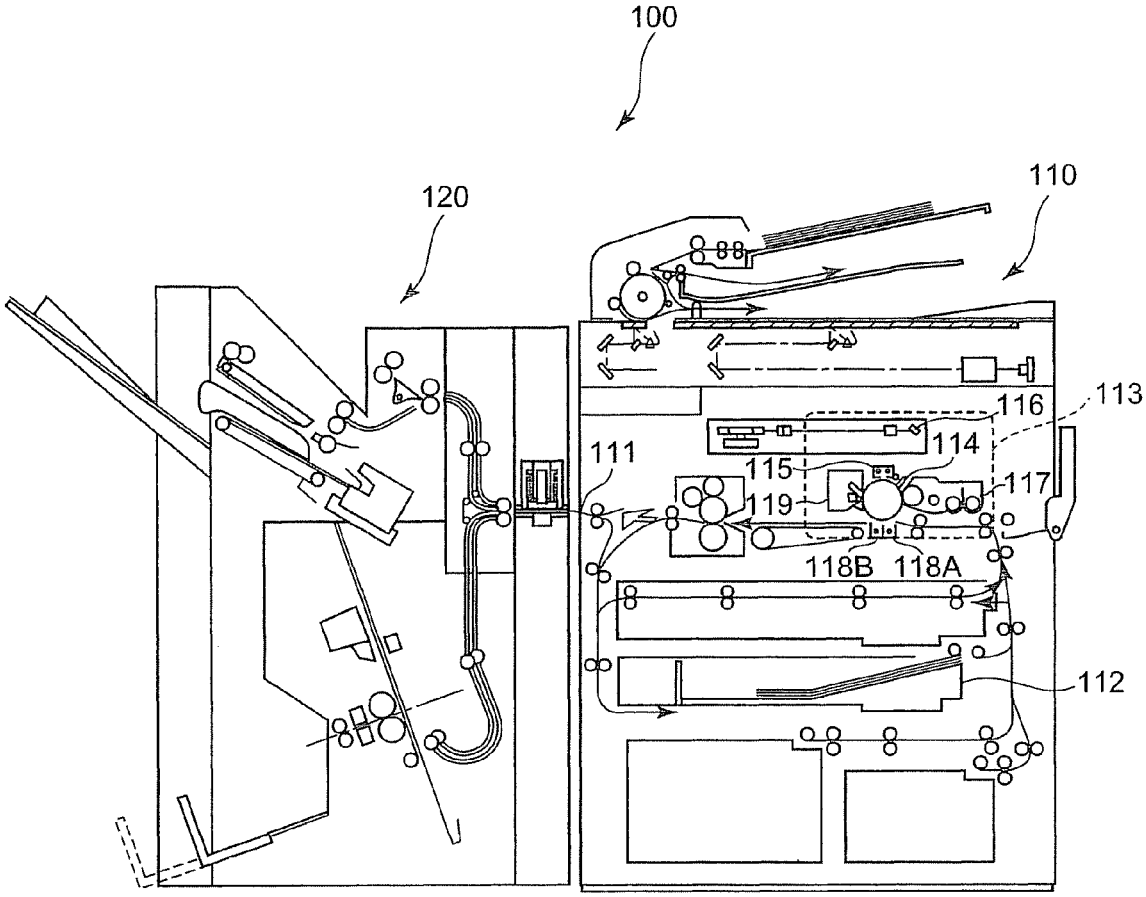
FIG. 1 is a cross sectional view showing the schematic constitution of the image forming apparatus having the sheet discharge apparatus relating to the first embodiment.

Hereinafter, the first embodiment will be explained with reference to FIGS. 1 to 13. FIG. 1 is a cross sectional view showing the schematic constitution of the image forming apparatus having the sheet discharge apparatus relating to the first embodiment.

A main body of image forming apparatus 110 can form monochromatic images and color images and is connected to a sheet post-process apparatus 120. The main body of image forming apparatus 110 includes a sheet storage portion 112 for storing sheets and an image forming portion 113 for forming images on sheets. The image forming portion 113 includes a rotating image transferring drum 114 and around it, a charging portion 115, an exposure portion 116, a developing portion 117, an image transferring portion 118A, a charge elimination portion 118B, and a cleaning portion 119. The surface of the image transferring drum 114 is charged by the charging portion 115, then is exposure-scanned by a laser beam of the exposure portion 116, and is reversely developed by the developing portion 117, thus a toner image is formed on the surface of the image transferring drum 114.

A sheet fed from the sheet storage portion 112 is arranged at the transfer position of the image forming portion 113 and the aforementioned toner image is transferred to it by the image transferring portion 118A. And, the sheet discharged by the charge elimination portion 118B is conveyed and discharged from the sheet discharge portion 111 and is carried into the sheet post-process apparatus 120.

After the aforementioned image forming process, the cleaning portion 119 removes toner remaining on the surface of the image transferring drum 1 1 4. By doing this, the apparatus is ready for the next image forming process.

Figure 2:
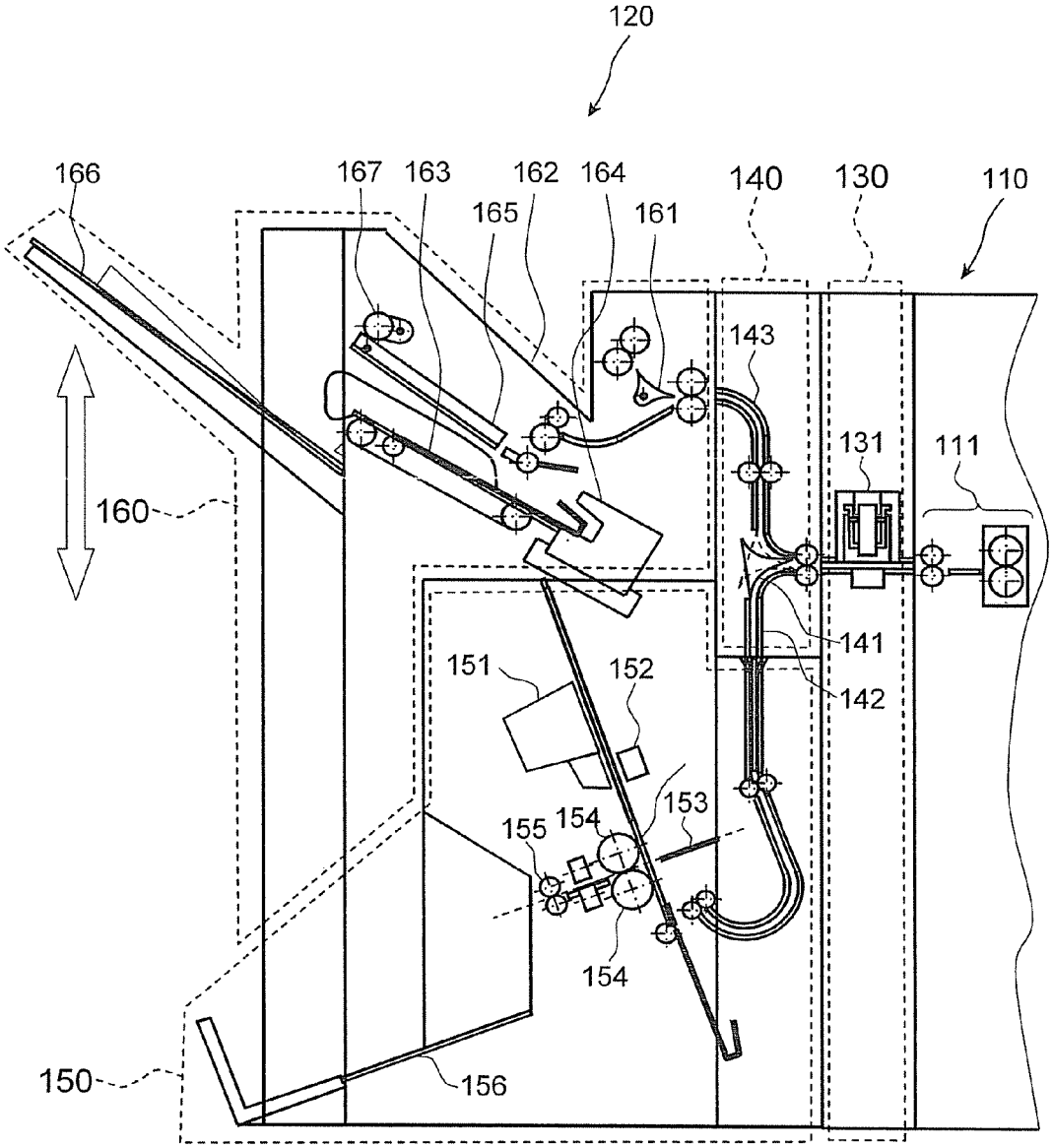
FIG. 2 is an enlarged view of the neighborhood of a sheet post-process apparatus 120 relating to the same embodiment.

FIG. 2 is an enlarged view of the neighborhood of the sheet post-process apparatus 120. The sheet post-process apparatus 120 is composed of a puncher unit 130 for performing the post process such as the punching process, a sheet flow divergent portion 140 for diverging sheets to either of a second post-process portion 150 and a first post-process portion 160, the second post-process portion 150 for performing the post process such as the center binding process or folding process, and the first post-process portion 160 for performing the post process such as sheet discharge from the ordinary print process, sorting of sheets, or binding the sheet bundle end. The sheet post-process apparatus 120, according to an input instruction of the operation panel of the main body of image forming apparatus 110 by a user or a print instruction of a personal computer connected to the image forming apparatus 100 via a LAN, conveys sheets to either of the second post-process portion 150 and first post-process portion 160 and performs the post process.

Sheets discharged from the sheet discharge portion 111 composed of a plurality of conveyor rollers are carried into the puncher unit 130 installed on the downstream side in the sheet conveying direction. The puncher unit 130 has a puncher 131 and punches sheets. The puncher unit 130, in this embodiment, functions as a part of the sheet post-process apparatus 120.

The sheets discharged from the puncher unit 130 are carried into a sheet flow divergent portion 140 installed on the downstream side in the sheet conveying direction. The sheet flow divergent portion 140 includes a divergent member 141 for deflecting the sheet conveying direction, a second conveying path 142 which is a sheet conveying path to the second post-process portion 150, and a first conveying path 143 which is a sheet conveying path to the first post-process portion 160. The divergent member 141, according to the sheet post process selected by the aforementioned print instruction by the user, deflects and leads the sheets toward either of the second conveying path 142 and first conveying path 143.

When performing the folding process and center binding process, the sheets deflected to the second conveying path 142 by the divergent member 141 are subjected to the binding process in two locations at the central part by a stapler 151 and an anvil 152. Next, the sheet bundle subjected to the center binding process is folded at the central part by a folding blade 153 and a folding roller 154. The sheet bundle subjected to the folding process is discharged to a stack tray 156 by discharge rollers 155.

On the other hand, when performing the post process such as sheet discharge from the ordinary print process, sorting of sheets, or binding the sheet bundle end, the sheets are deflected to the first conveying path 143 by the divergent member 141 and are conveyed to the first post-process portion 160. The first post-process portion 160 includes a divergent member 161 for switching the conveying path according to the selected post process, a roof tray 162 for loading sequentially ordinary print sheets, a processing tray 163 for loading a sheet bundle to be subject to the binding process, a stapler 164 for binding sheet bundles, a standby tray 165 for temporarily collecting conveyed sheets to ensure the time necessary for the binding process and sheet transfer, and a receiving tray 165 for loading a sheet bundle which is bound and sorted. Sheets carried in from the first conveying path 143 are deflected and led in either of the upward and downward directions by the divergent member 161.

Inside the first post-process portion 160, although explanation using illustrations and numerals is omitted, in addition to the components aforementioned, various conveying rollers for making contact with or conveying sheets and other devices are installed. These devices are driven by electrical equipment such as various motors and solenoids. Further, these electric equipment are controlled by a control system including a microprocessor which will be described later. For the first post-process portion 160, for example, the constitution described in Japanese Patent Application Publication No. 2007-76862 may be used.

In the ordinary print performing no other special post processes except the process by the puncher unit 130, sheets are deflected in the conveying path by the divergent member 141 and are led to the first conveying path 143. Then, the sheets are deflected upward by the divergent member 161 and can be discharged to the roof tray 162 by the conveying rollers. Further, the sheets are deflected downward by the divergent member 161 and sheets loaded on the standby tray 165 may be discharged to the receiving tray 166.

When performing the binding process of the sheet bundle end or the sorting process for printing sheets without performing the binding process and folding process, the sheets are led to the first conveying path 143 by the divergent member 141. Then, the sheets are deflected downward by the divergent member 161 and are discharged to the standby tray 165 by the conveying rollers.

The standby tray 165 is composed of a pair of intermediate standby tray components (not drawn) capable of moving right and left and when the standby tray components are closed, receives sheets. The standby tray 165 stores temporarily sheets conveyed sequentially, thereby adjusts the sheet conveying flow, ensures the time required for sheet transport and binding of the sheet bundle end, described later, which are executed on the downstream side of the sheet conveying path, thus makes the sheet post processing smooth. Further, an intermediate standby tray roller 167 aligns the sheets stored on the standby tray 165.

When a predetermined number of sheets is stored in the standby tray 165, the intermediate standby tray components are opened and the sheet bundle, by the operation of a falling auxiliary member for making it fall by its own weight or forcibly, slides down to the processing tray 163. The sheet bundle, on the processing tray 163, is subject to the aligning process for aligning the vertical and horizontal ends by the aligning member (not drawn).

When closing the sheet bundle, if the predetermined number of sheets is aligned and stored on the processing tray 163, the binding process is performed by the stapler 164. The sheet bundle subjected to the binding process by the stapler 164 is transported to and stacked in the receiving tray 166.

When performing only the sorting process, the sheet bundle conveyed to and aligned by the processing tray 163 is not subject to the binding process by the stapler 164 and is transported to and stacked in the receiving tray 166. The receiving tray 166 is shifted vertically in the direction of the arrow shown in the drawing by a vertically movable motor, a gear, and a belt which are not drawn.

Figure 3A:
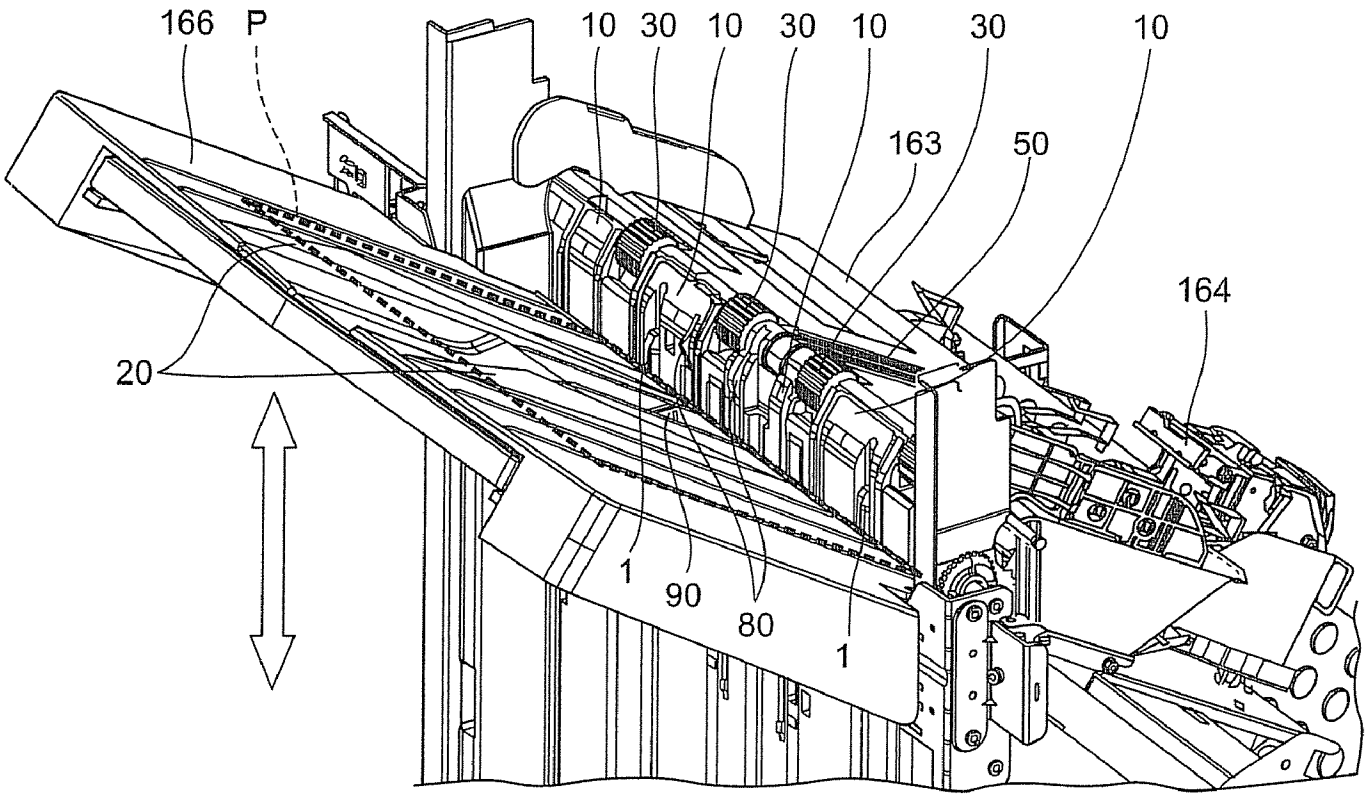
FIG. 3A is a perspective view showing the neighborhood of a receiving tray 166 of a first post-process portion 160 relating to the same embodiment.
Figure 3B:
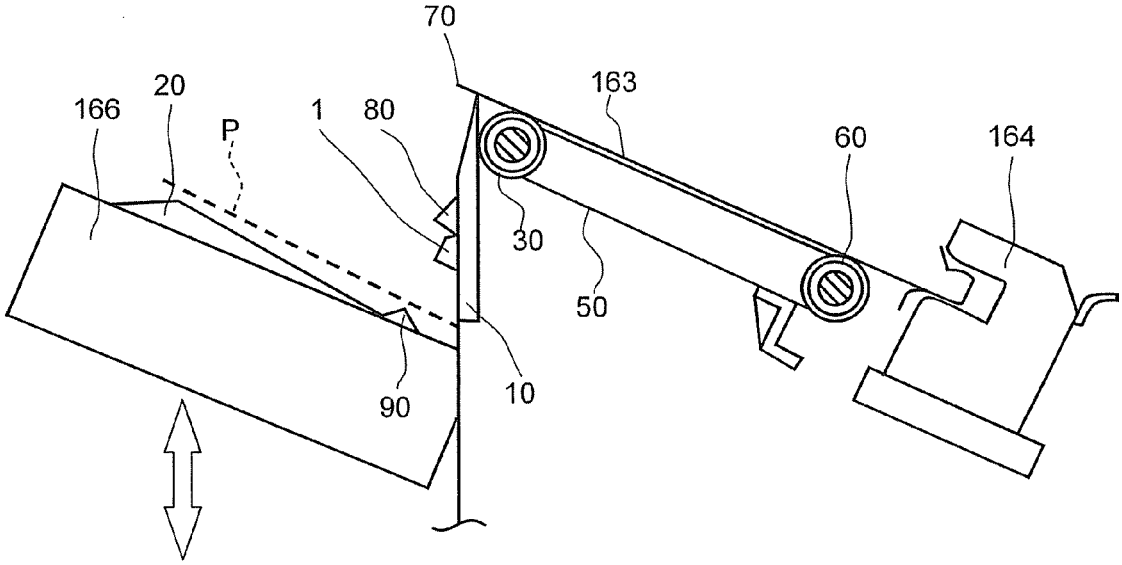
FIG. 3B is a cross sectional view showing the neighborhood of the receiving tray 166 of the first post-process portion 160 relating to the same embodiment.

Hereinafter, by referring to FIGS. 3A and 3B, the neighborhood of the receiving tray 166 of the first post-process portion 160 will be explained in detail. FIG. 3A is a perspective view showing the neighborhood of the receiving tray 166 of the first post-process portion 160. Further, FIG. 3B is a cross sectional view showing the neighborhood of the receiving tray 166 of the first post-process portion 160. Further, in the drawings, the same portions are assigned the same numerals for explanation.

A conveying belt 50 and a plurality of discharge rollers 30 are installed to convey the sheets P on the processing tray 163 after the sheets P is sorted or stapled. The discharge rollers 30 are controlled in rotation by the drive portion and rotate when transporting the sheets P to the receiving tray 166. A roller 60, when leading the aligned sheets toward the stapler 164 and when discharging the stapled sheets P, rotates in the opposite direction.

The sheets P conveyed by the conveyer belt 50 are discharged from the discharge spout 70 to the receiving tray 166. The discharged sheets P are received by the receiving tray 166 moving vertically in the direction of the void arrow by the drive portion (not drawn).

In the neighborhood of the discharge spout 70, a shutter portion 10 as a wall member moving vertically in the direction parallel with the void arrow independently of or linking with the vertically moving operation (in the direction of the void arrow) of the receiving tray 166 is installed. The shutter portion 10 is composed of a plurality of laminar members arranged at a predetermined interval and the plurality of laminar members integrally moves vertically. The shutter portion 10 is controlled in the vertical movement so as to prevent the discharged sheets P from reversely flowing to the discharge spout 70 when the receiving tray 166 moves to the height of the neighborhood of the discharge spout 70.

On the shutter portion 10, a first sensor 80 for detecting the uppermost surface of the sheets P received by the receiving tray 166 and a holding member 1 for holding the end portion of the sheets P on the side of the shutter portion 10 (hereinafter, referred to as the back-end portion of the sheets P) are installed. On the two laminar members forming the central part of the shutter portion 10, a pair of first sensors 80 is installed. The first post-process portion 160, according to detection results of the first sensors 80, controls the height position of the receiving tray 166. A pair of holding members 1 is installed on the shutter portion 10 so as to hold the pair of first sensors 80 therebetween.

The receiving tray 166 retains the sheets P discharged from the discharge spout 70 on the tray and in order to strike and align them against the shutter portion 10, has a predetermined angle of inclination. On the receiving tray 166, a second sensor 90 for detecting existence of sheets on the tray and /\-shaped ribs 20, which will be described later, are installed. The second sensor 90 is a weight sensor and when the sheets P are discharged on the receiving tray 166, they can be detected by the second sensor 90.

Figure 4:
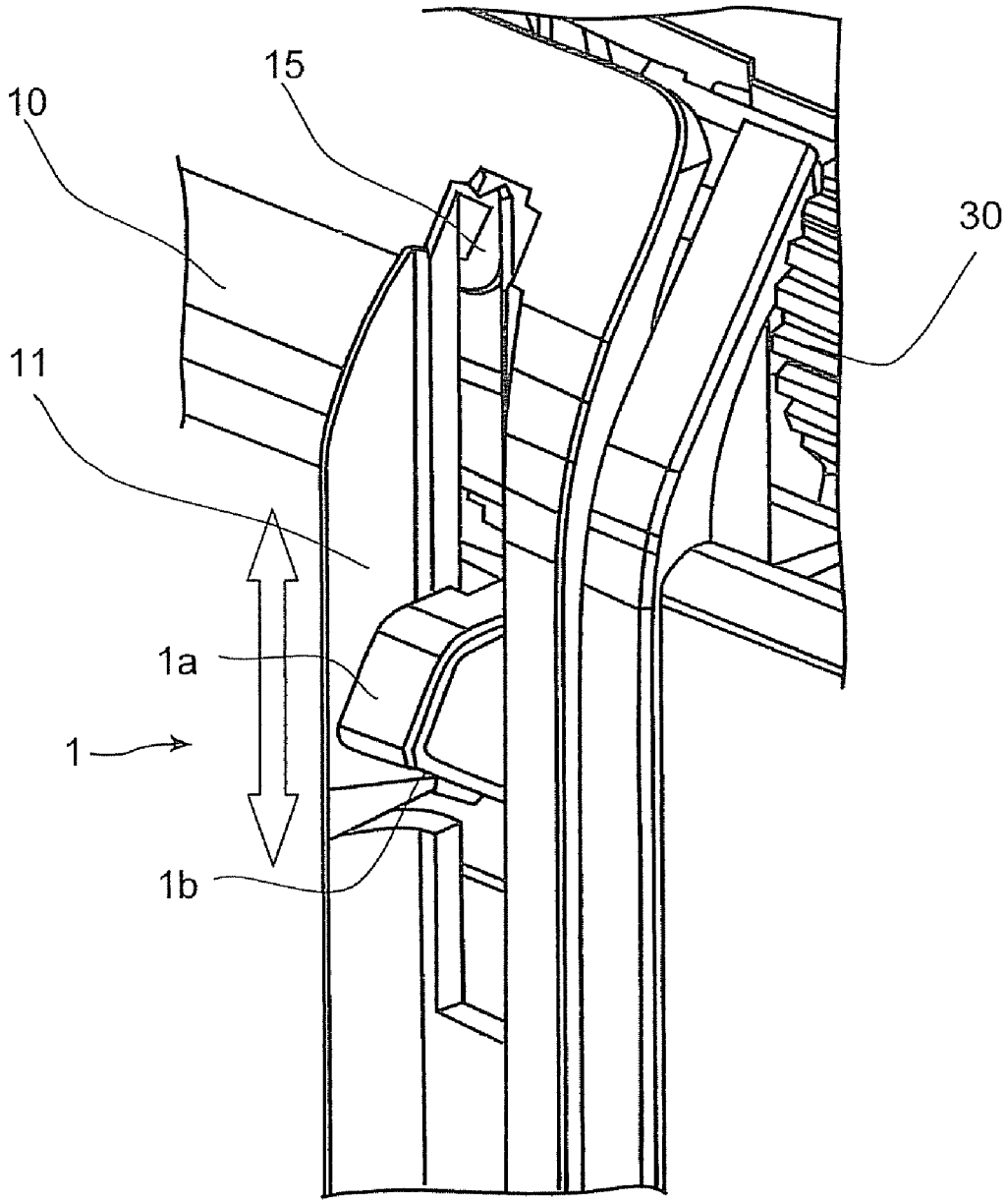
FIG. 4 is a perspective view of the enlarged neighborhood of a holding member 1 relating to the same embodiment.

FIG. 4 is a perspective view of the enlarged neighborhood of the holding member 1. The shutter portion 10 is provided with a concave portion 11. On the bottom of the concave portion 11, an opening portion 15 is formed. The holding member 1 projected from the opening portion 15 includes a head portion 1*a* and a holding portion 1*b* which are projected from the surface of the shutter portion 10.

The holding member 1, within the range where the uppermost part of the head portion 1*a* and the lowest part of the holding portion 1*b* touch respectively the upper and lower limits of the opening portion 15, can move vertically (in the direction of the void arrow) in the concave portion 11. The holding member 1, as described later, upon receipt of the pressure when a sheet hits on the head portion 1*a*, rotates easily, thus the part projected from the surface of the shutter portion10 can be stored in the concave portion 11. By doing this, the sheets discharged onto the receiving tray 166 are interrupted by the holding member 1, thus the discharge fall orbit can be suppressed from changing.

The holding portion 1*b* has an angle so that it is almost parallel with the surface of the receiving tray 166. Except when the holding member 1 rotates, the holding member 1 moves vertically when the holding portion 1*b* keeps the aforementioned angle. Further, the holding member 1, as described later, is pressed downward. Therefore, when the receiving tray 166 moves up or the shutter portion 10 only moves down, the holding member 1 can hold the back-end portion of the sheets on the tray almost perpendicularly to the tray surface. Further, it is possible to install a member (for example, rubber) with a high friction coefficient on the surface of the holding portion 1*b*, thereby promote the holding effect aforementioned.

Figures 5A, 5B:
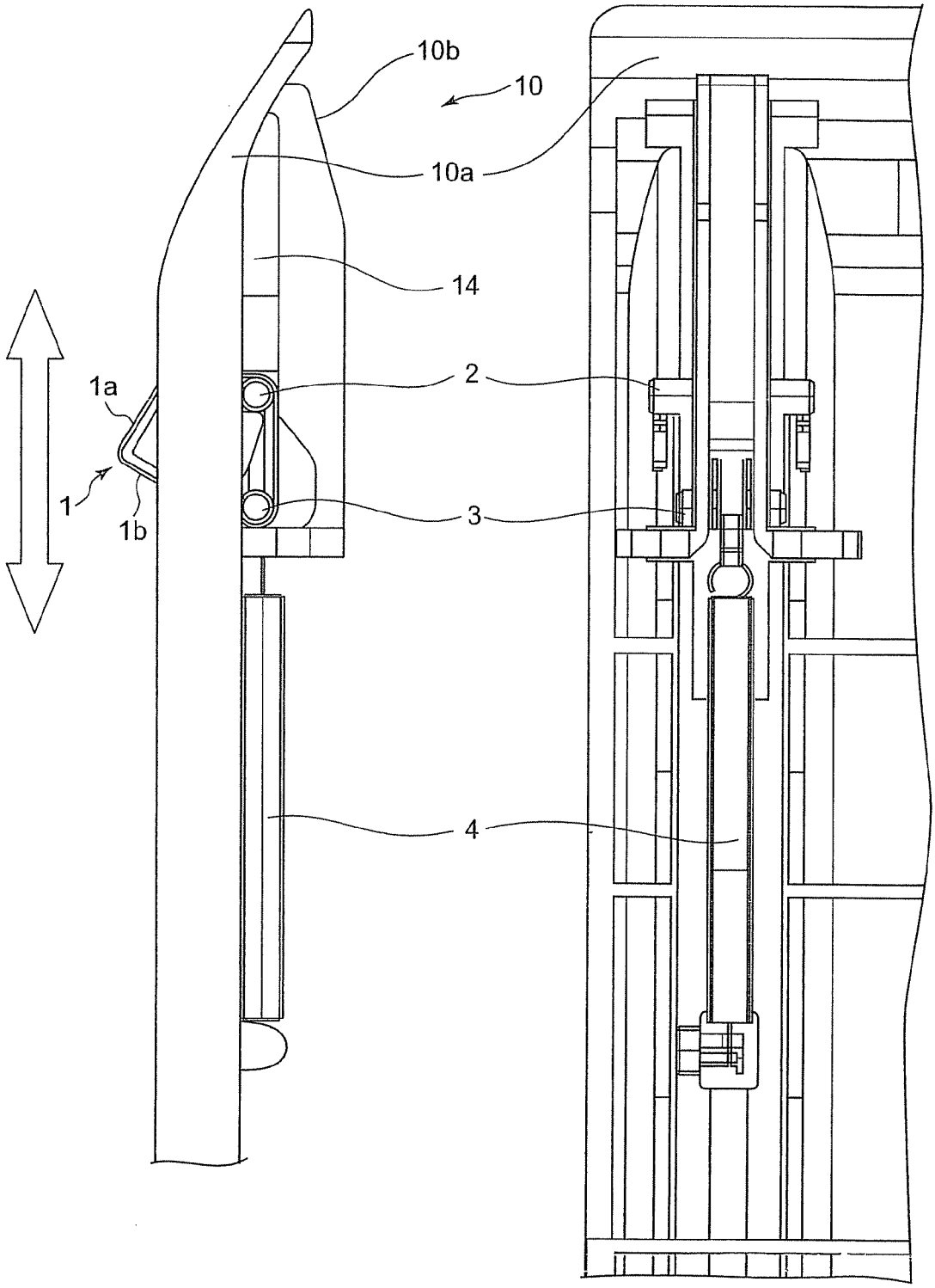
FIG. 5A is a cross sectional view showing the constitution of the neighborhood of the holding member 1, which is viewed from the side, relating to the same embodiment.
FIG. 5B is a cross sectional view showing the constitution of the neighborhood of the holding member 1, which is viewed from the back, relating to the same embodiment.

FIGS. 5A and 5B respectively show a cross sectional view from the side indicating the constitution of the neighborhood of the holding member 1 and a cross sectional view from the back. The shutter portion 10 is composed of a front face portion 10*a* of the shutter, a back face portion 10*b* of the shutter, and a guide slot 14 which is an air gap provided between the front face portion 10*a* of the shutter and the back face portion 10*b* of the shutter.

Inside the guide slot 14 of the holding member 1, a first guide pin 2 and a second guide pin 3 are installed. The guide slot 14, excluding the holding member rotation portion which will be described later, has an interval where the first guide pin 2 and second guide pin 3 can slide. The first guide pin 2 and second guide pin 3 which are installed in the holding member 1 slide inside the guide slot 14, thus the holding portion 1*b* keeps the predetermined angle when it is almost parallel with the surface of the receiving tray 166 and the holding member 1 can move vertically.

To the lower part inside the guide slot 14 of the holding member 1, one end of a coil spring 4 is connected. The other end of the coil spring 4 is connected to the lower part of the back of the front face portion 1*a* of the shutter. By doing this, when the holding member 1 moves vertically, the holding member 1 is pressed downward.

Figures 6A, 6B:
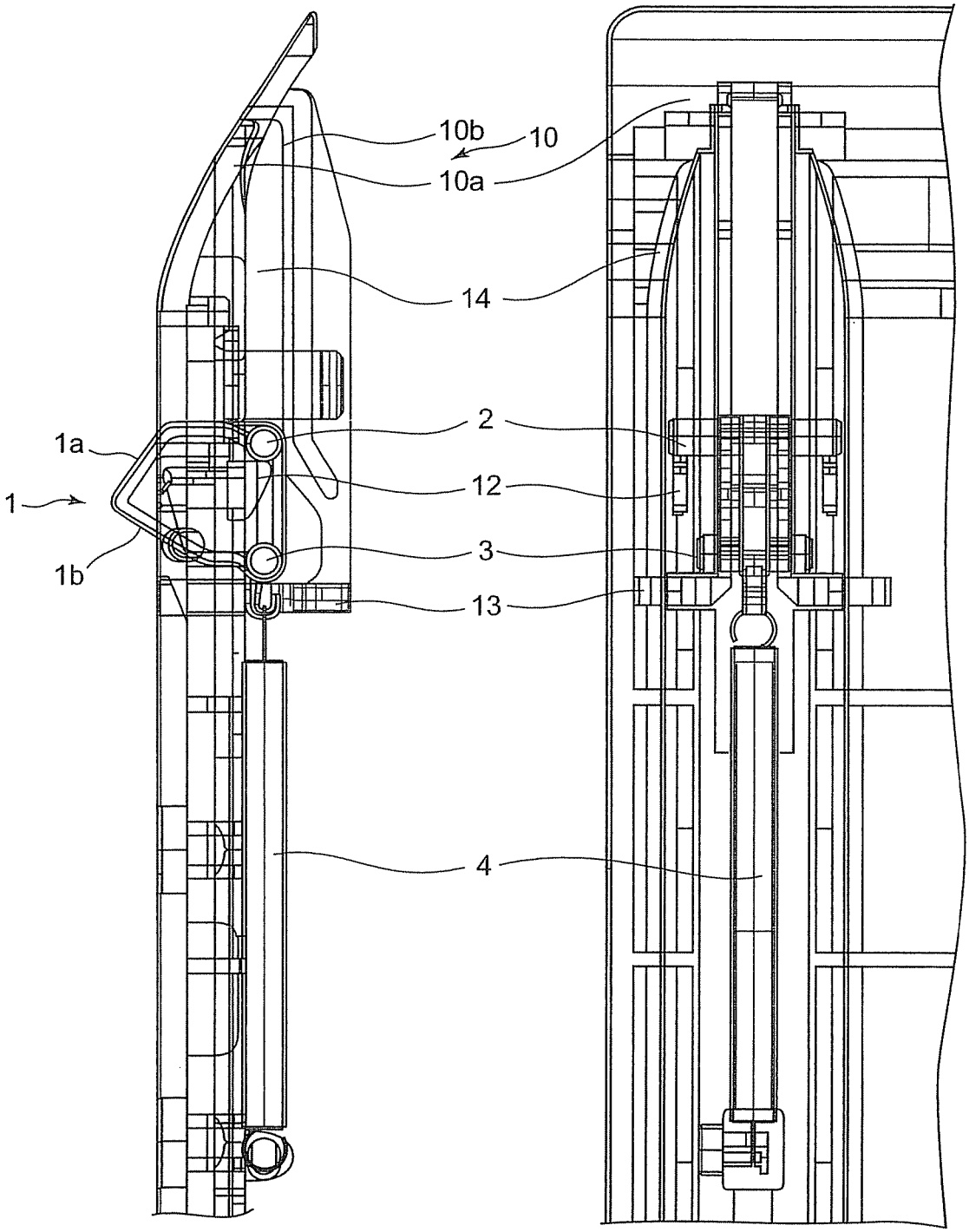
FIG. 6A is a cross sectional view showing the constitution of the neighborhood of the holding member 1 at the time of standby, which is viewed from the side, relating to the same embodiment.
FIG. 6B is a cross sectional view showing the constitution of the neighborhood of the holding member 1 at the time of standby, which is viewed from the back, relating to the same embodiment.

FIGS. 6A and 6B respectively show a cross sectional view from the side and a cross section view from the back indicating the constitution of the neighborhood of the holding member 1 when the holding member 1 is in the standby state. In the guide slot 14, a first stopper 12 for receiving the first guide pin 2 and stopping the downward movement thereof and a second stopper 13 for receiving the second guide pin 3 and stopping the downward movement thereof are installed and the lower limit of the downward movement of the holding member 1 is decided.

Figures 7A, 7B:
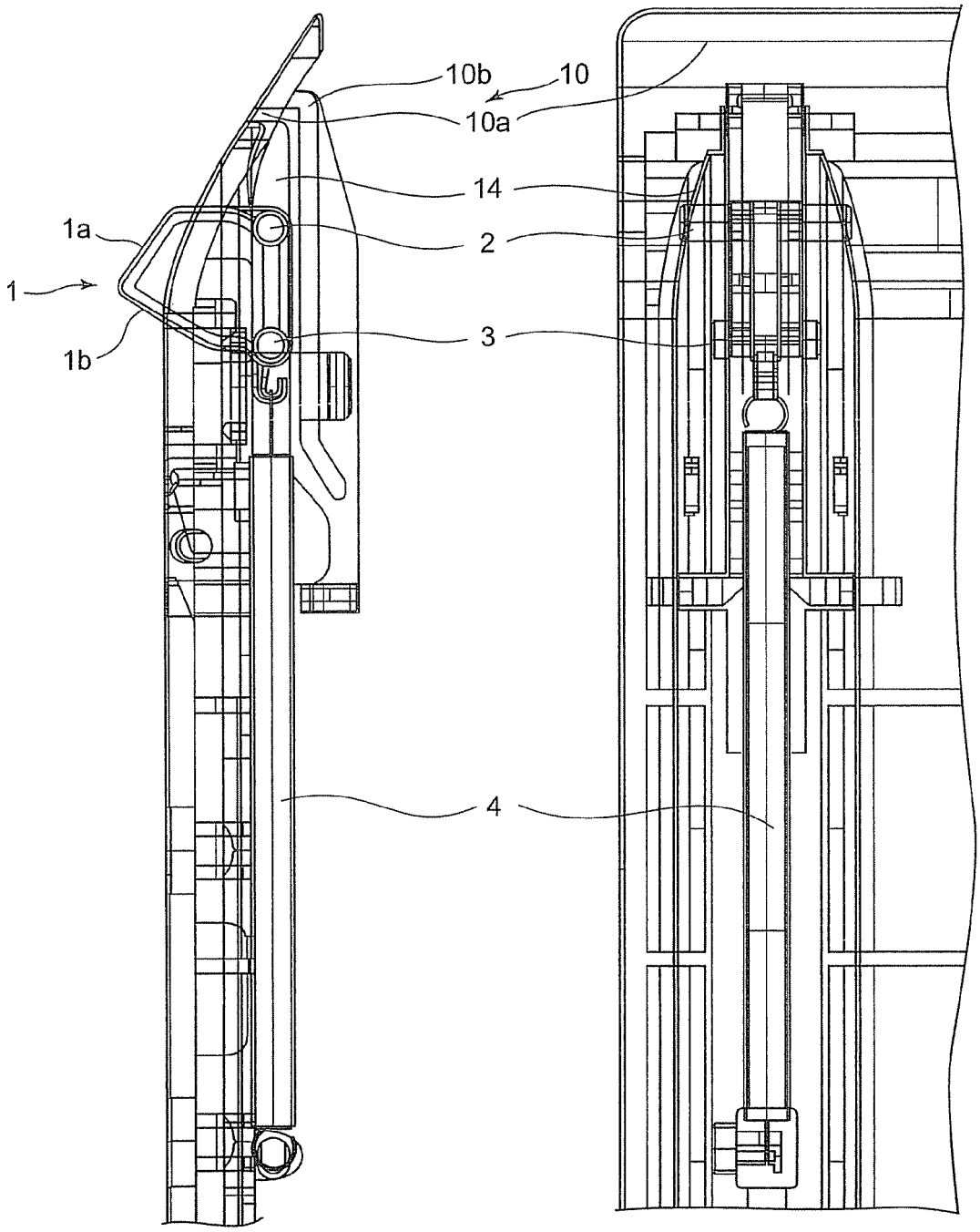
FIG. 7A is a cross sectional view showing the constitution of the neighborhood of the holding member 1 at the time of upward movement, which is viewed from the side, relating to the same embodiment.
FIG. 7B is a cross sectional view showing the constitution of the neighborhood of the holding member 1 at the time of upward movement, which is viewed from the back, relating to the same embodiment.

FIGS. 7A and 7B respectively show a cross sectional view from the side and a cross section view from the back indicating the constitution of the neighborhood of the holding member 1 when the holding member 1 moves up. The guide slot 14 is shaped so that the air gap in the width direction becomes narrower toward the end thereof. Therefore, when the width of the guide slot 14 becomes equal to the length of the first guide pin 2 in the longitudinal direction, the upward movement of the first guide pin 2 is stopped, thus the upper limit of the upward movement of the holding member 1 is decided.

Further, compared with FIG. 6, the length of the coil spring 4 in the longitudinal direction is extended. From the characteristics of the coil spring 4, the recovery force is increased in proportion to the extended length. Namely, in the state shown in FIG. 7, the force for pressing downward the holding member 1 is stronger than that in the state shown in FIG. 6. As the stacking height of sheets increases, the undulation of the uppermost sheet is changed and it is difficult to maintain the alignment of the sheet bundle. According to the aforementioned constitution, as the stacking height of sheets increases, the holding force by the holding member 1 increases, so that the aforementioned problem can be suppressed.

Figure 8:
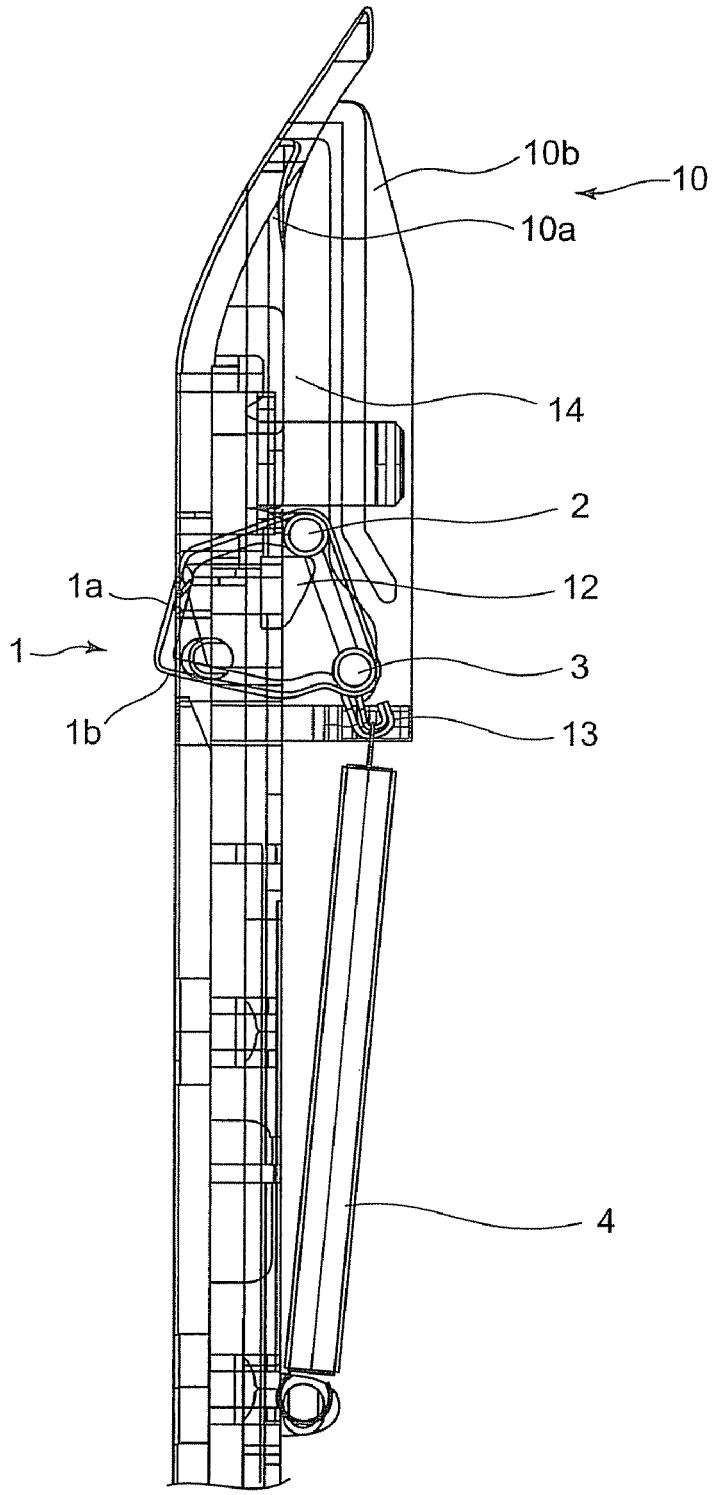
FIG. 8 is a cross sectional view showing the constitution of the neighborhood of the holding member 1 at the time of rotation, which is viewed from the side, relating to the same embodiment.

FIG. 8 is a cross sectional view of the constitution of the neighborhood of the holding member 1 viewed from the side at the time of rotation of the holding member 1. On the lower part of the guide slot 14, a space which expands in the thickness direction and is wider than the sliding range of the guide pin is formed. Therefore, when the head portion 1*a* of the holding member 1 is pressurized, on axis of the first guide pin 2 supported by the first stopper 12, the second guide pin 3 moves toward the back face portion 10*b* of the shutter and the holding member 1 can be rotated.

When the holding member 1 rotates, the holding member 1 can store at least a part of the parts (the head portion 1*a* and holding portion 1*b*) projected from the front face portion 10*a* of the shutter in the front face portion 10*a* of the shutter. By doing this, the back-end portions of the sheets which are discharged and fallen on the tray are interrupted by the holding member 1 and the discharge fall orbit can be prevented from changing.

The coil spring 4 connected to the holding member 1, as shown in the drawing, is inclined toward the back face portion 10*b* of the shutter. Compared with the case of the holding member 1 in the standby state (refer to FIG. 6A), the length of the coil spring 4 is extended slightly. Therefore, on the coil spring 4, force of returning from the state shown in FIG. 8 to the state shown in FIG. 6 is acted.

Namely, when discharged sheets collide with the head portion 1*a* of the holding member 1, even if the force of the collision of the sheets (particularly a sheet bundle) is small, the holding member 1 rotates, so that the projections can be stored in the front face portion 10*a* of the shutter. Further, when the pressure applied to the head portion 1*a* is eliminated, by the recovery force of the coil spring 4, the head portions 1*a* and 1*b* of the holding member 1 can be returned again to the state that they are projected from the front face portion 10*a* of the shutter (refer to FIG. 6).

Figure 9:
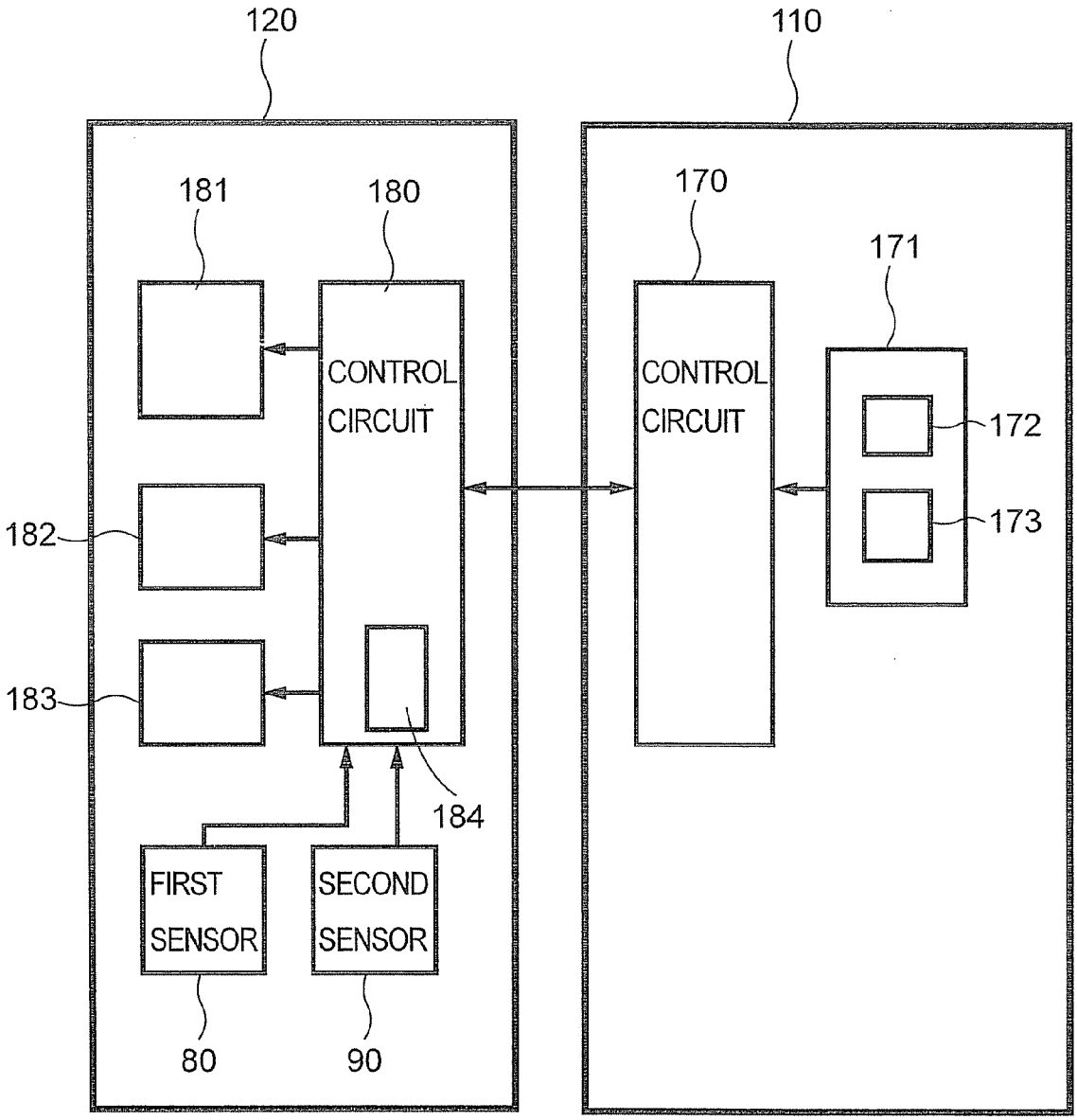
FIG. 9 is a block diagram showing the control system for controlling an image forming apparatus 100 relating to the same embodiment.

Next, by referring to FIGS. 9 to 11, the operation of holding sheets will be explained. FIG. 9 is a block diagram showing the control system for controlling the image forming apparatus 100. In FIG. 9, a control circuit 170 is a control circuit for controlling the main body of image forming apparatus 110, which is composed of, for example, a microprocessor including a CPU and in response to the operation of an operation portion 171, controls each unit for image formation.

The operation portion 171 includes various keys 172 and a display 173 of a touch panel type. For example, the number of copies is instructed by using the keys 172 and the sheet size, sheet kind, and stapling are instructed by operating the touch panel of the display 173.

Further, a control circuit 180 is a control circuit for controlling the sheet post-process apparatus 120, which is composed of, for example, a microprocessor including a CPU. The control circuit 180 transfers mutually information with the control circuit 170 of the main body of image forming apparatus 110 and so as to interconnect the image forming operation and the operation of the sheet post-process apparatus 120, controls each unit for the sheet post process.

Further, the control circuit 180 controls a motor 181 for moving vertically the receiving tray 166, a motor 182 for driving the shutter portion 10, and a motor 183 for driving the conveyer belt 50. Namely, the control circuit 180 composes the control portion for the receiving tray for controlling vertical movement of the receiving tray 166, the control portion for the shutter portion for controlling vertical movement of the shutter portion 10, and the discharge control portion for controlling discharge of sheets by the conveyer belt 50.

Furthermore, to the control circuit 180, detection results from the first sensor 80 and second sensor 90 are input. The control circuit 180 moves vertically the receiving tray 166 in response to the detection results from the first sensor 80 and second sensor 90. Further, the control circuit 180 has a counter 184 for operating in response to the detection results of the second sensor 90.

Figure 10A:
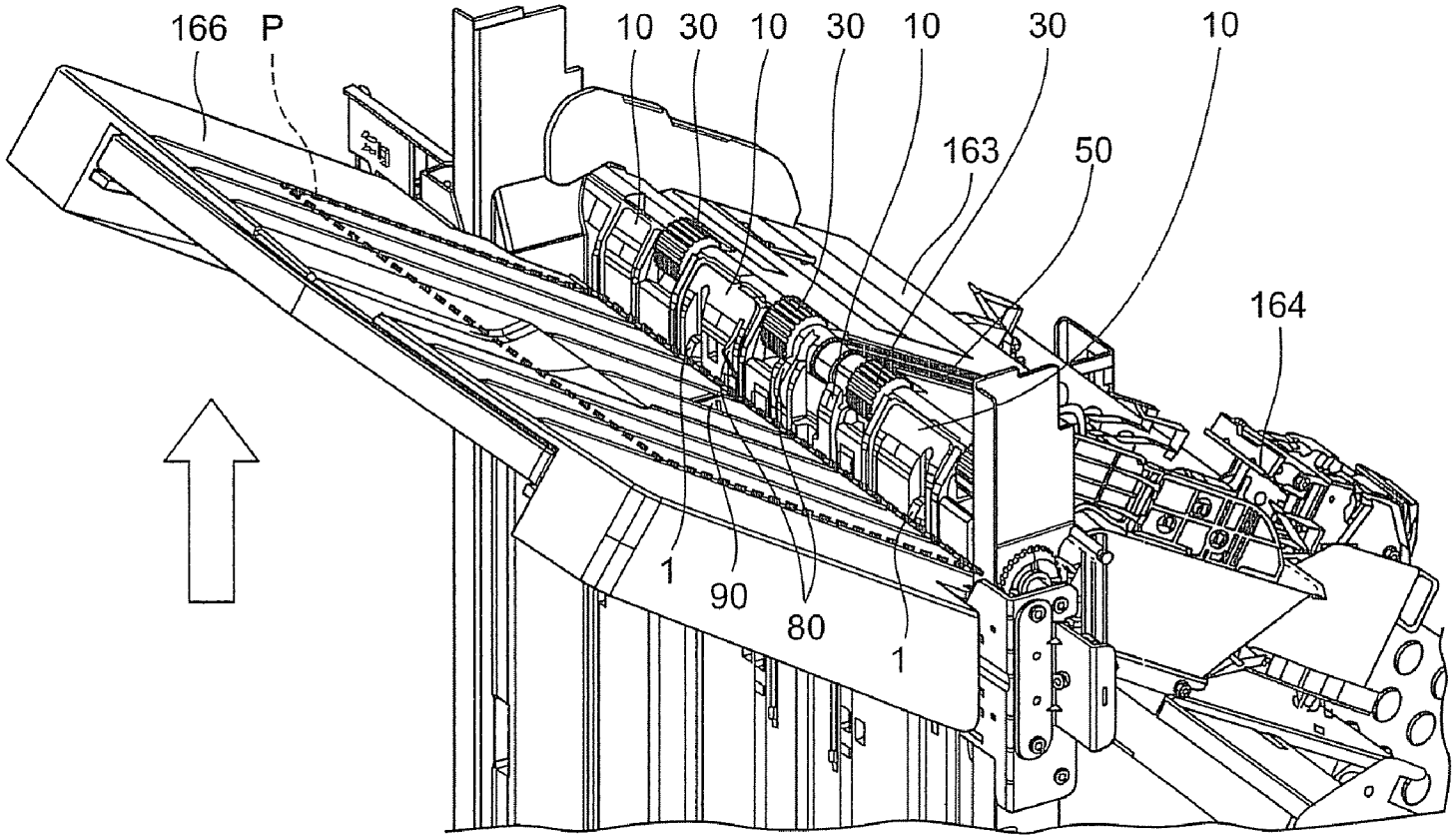
FIG. 10A is a perspective view showing the neighborhood of the receiving tray 166 of the first post-process portion 160 when the receiving tray 166 relating to the same embodiment moves up and the back-end portion of a sheet P is held by the holding member 1.
Figure 10B:
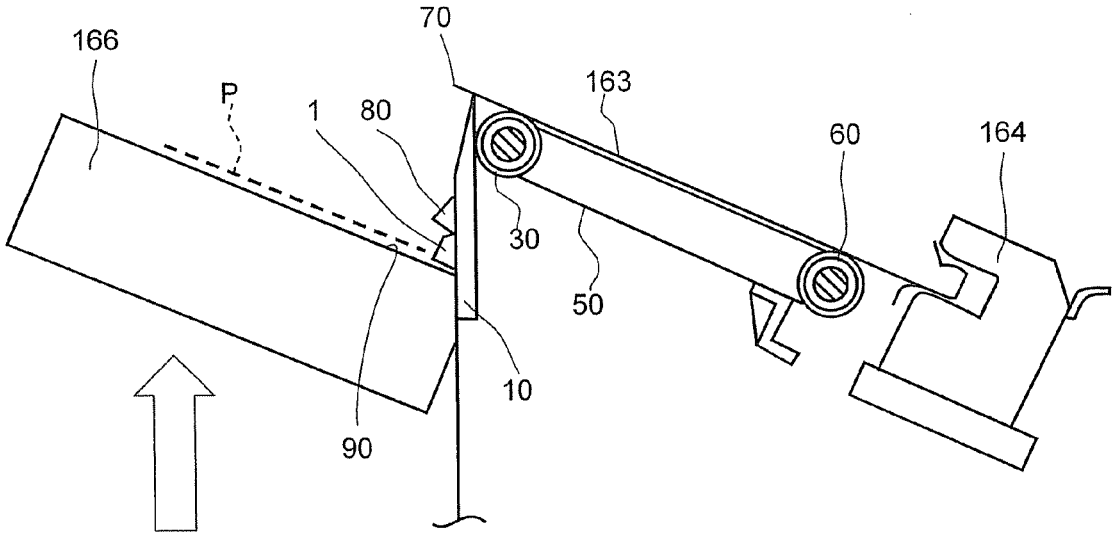
FIG. 10B is a cross sectional view showing the schematic constitution of the neighborhood of the receiving tray 166 of the first post-process portion 160 when the receiving tray 166 relating to the same embodiment moves up and the back-end portion of the sheet P is held by the holding member 1.

FIG. 10A is a perspective view showing the neighborhood of the receiving tray 166 of the first post-process portion 160 when the receiving tray 166 moves up and the back-end portion of the sheets P is held by the holding member 1. Further, FIG. 10B is a cross sectional view showing the schematic constitution of the neighborhood of the receiving tray 166 of the first post-process portion 160 when the receiving tray 166 moves up and the back-end portion of the sheets P is held by the holding member 1.

The sheets P sorted or a sheet bundle stapled is discharged to the receiving tray 166 by rotation of the conveyer belt 50. At this time, the receiving tray 166 receives the sheets P discharged at the height (refer to FIG. 3) of the standby position not in contact with the holding member 1. The sheets P received by the receiving tray 166 slide down toward the shutter portion 10 due the inclination provided to the receiving tray 166, and the back-end portion of the sheets P hits on the shutter portion 10, thus the sheets P are aligned in the sheet transport direction. At this time, the back-end portion of the sheets P exists between the receiving tray 166 and the holding member 1.

The motor 182 for driving the conveyer belt 50 is a stepping motor operating in synchronization with pulse power. The drive pulse is counted by a counter not drawn and when it reaches a predetermined count, the receiving tray 166 or the shutter portion 10 is controlled in vertical movement. By doing this, the timing of the operation (chuck operation) of clamping and holding the back-end portion of the sheets P and the operation (release operation) of releasing the back-end portion can be realized optimally.

The sensor 90 installed in the receiving tray 166 detects that the sheets P are discharged to the receiving tray 166 and a counter 184 of the control circuit 180 starts the count operation. Further, the control circuit 180 permits the receiving tray 166 to move up, thereby permits the holding member 1 which is pressed downward and can move vertically and the receiving tray 166 to clamp the back-end portion of the sheets P. By doing this, the aligned sheets P are held in the state that the alignment is maintained.

Figure 11A:
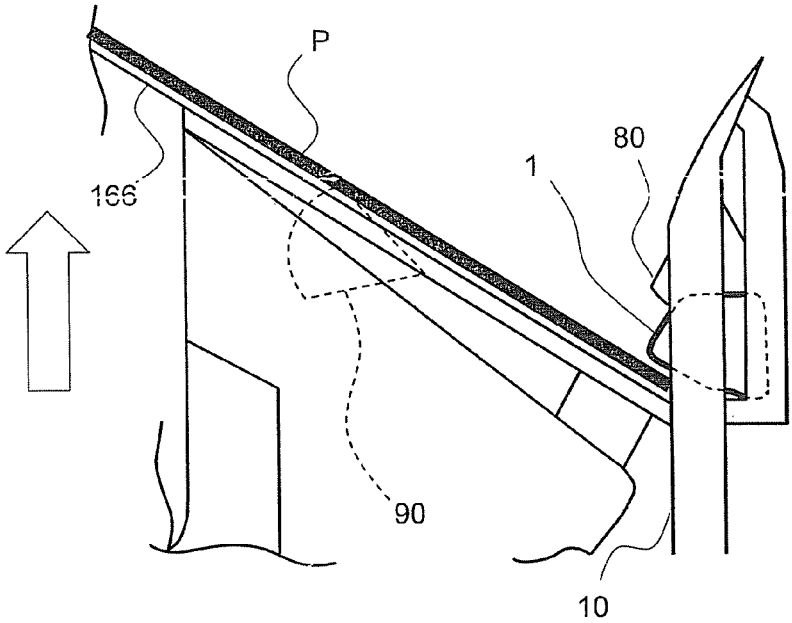
FIGS. 11A and 11B are cross sectional views showing the neighborhood of the holding member 1 when the receiving tray 166 relating to the same embodiment moves up.
Figure 11B:
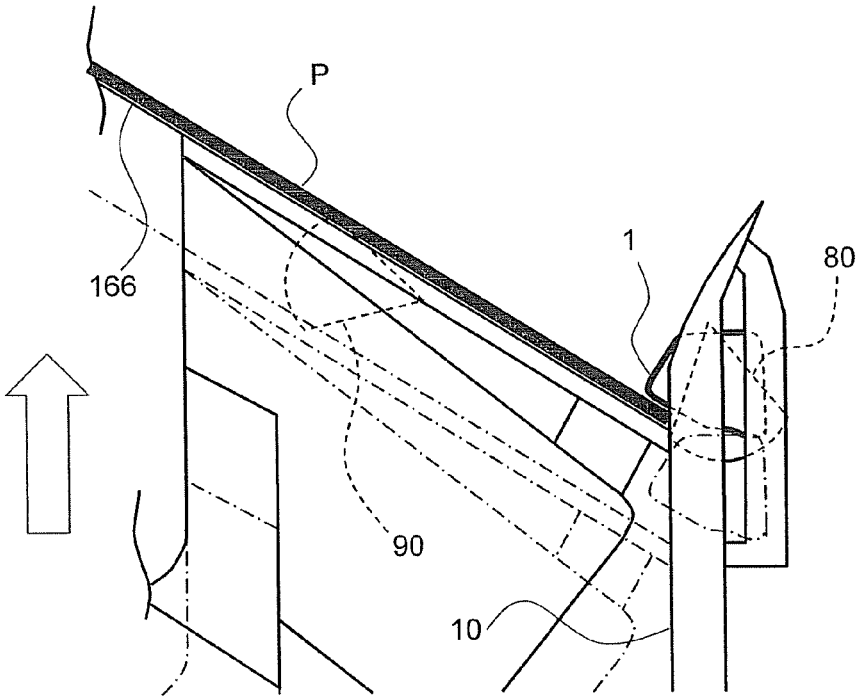

FIGS. 11A and 11B show cross sectional views of the neighborhood of the holding member 1 when the receiving tray 166 moves up. FIG. 11A shows the state that the holding member 1 and receiving tray 166 clamp the back-end portion of the sheets P. FIG. 11B shows the state that the receiving tray 166 moves up more up to the height position where the back-end portion of the sheets P makes contact with the first sensor 80.

The holding member 1 pressed downward can slide inside the shutter portion 10, so that in the state that the sheets P are held by the holding member 1 and tray surface, the receiving tray 166 moves up. The tray moves up and the back-end portion of the sheets P makes contact with the first sensor 80, thus the sensor can detect the uppermost surface of the sheets loaded on the receiving tray 166. The detection results are input to the control circuit 180.

When discharging the next sheets, until the next sheets strike against and make slide-contact with the sheets P existing already on the tray 166, the back-end portion of the sheets P is pressed to the tray by the holding member 1. By doing this, the sheets discharged next make slide-contact with and strike out the sheets held already on the tray, thus the alignment can be prevented from disturbance such as a shift.

When the sheets discharged next are received by the receiving tray 166 and slide down to the shutter portion 10, the receiving tray 166 moves down and the nest sheets and sheets P are controlled so as to be inserted between the holding member 1 and the movable receiving tray. This series of operations is repeated, thus the alignment of sheets loaded on the receiving tray 166 is ensured and newly discharged sheets can be received.

The counter 184 counts sequentially sheets discharged from the main body of image forming apparatus 110 and when the number of sheets loaded on the receiving tray 166 reaches a predetermined number of sheets, plays a roll in informing a user of it by an alarm. Namely, it is used to inform that the tray 166 is in the full state.

Further, at the time of discharge of sheets, the receiving tray 166, as shown in FIG. 3A, stands by at the height position (hereinafter, referred to as the standby position) of the neighborhood of the first sensor 80. As the sheets loaded on the receiving tray 166 increase, the control of downward-moving of the standby position of the receiving tray 166 is executed so as to prevent the uppermost surface of the sheets from exceeding the height position of the first sensor 80 (hereinafter, referred to the first height position).

Namely, the receiving tray 166 moves down once every discharge of sheets and then moves up again. And, when the back-end portion of the sheets is held by the holding member 1 and then the top of the sheets on the receiving tray 166 is detected by the sensor 80, the receiving tray 166 is stopped at the position, thus the top of the sheets is kept always at the first height position. Therefore, the holding member 1 installed below the first sensor 80, before the top of the sheets is detected by the first sensor 80, always presses the back-end portion of the loaded sheets, so that erroneous detection of the first sensor 80 can be prevented.

Figure 12A:
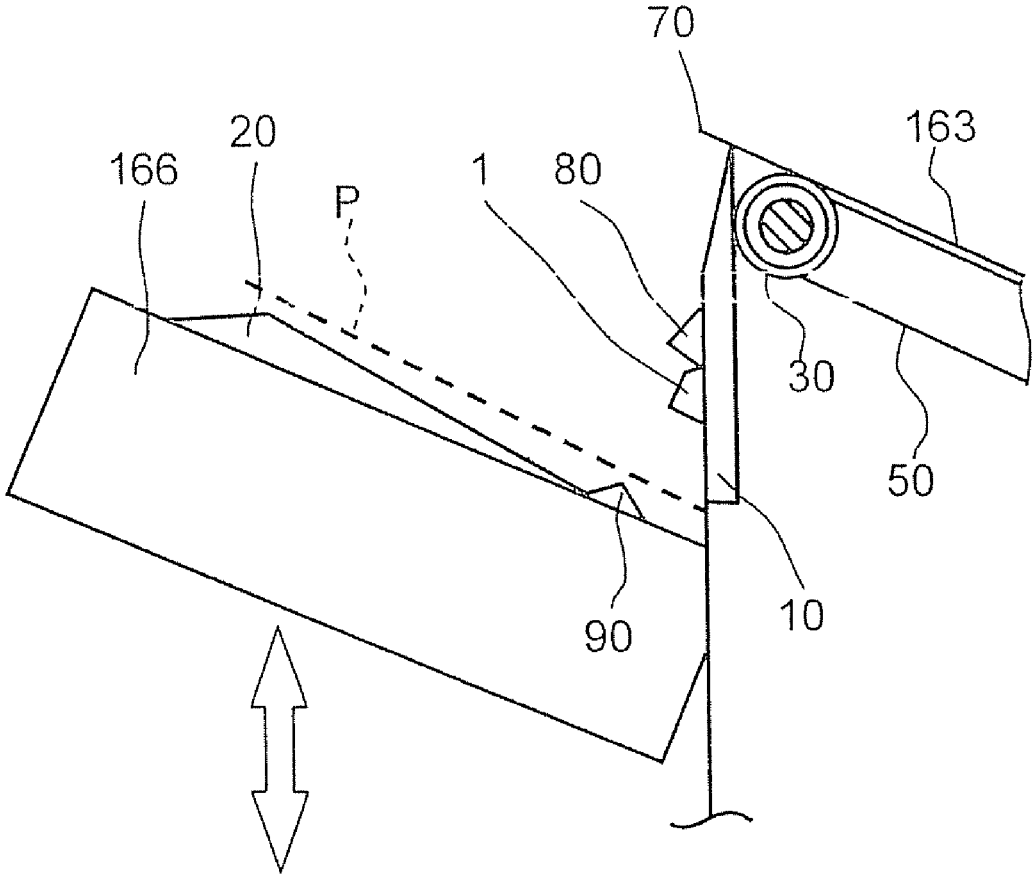
FIG. 12A is a cross sectional view showing a part of FIG. 3B relating to the same embodiment.
Figure 12B:
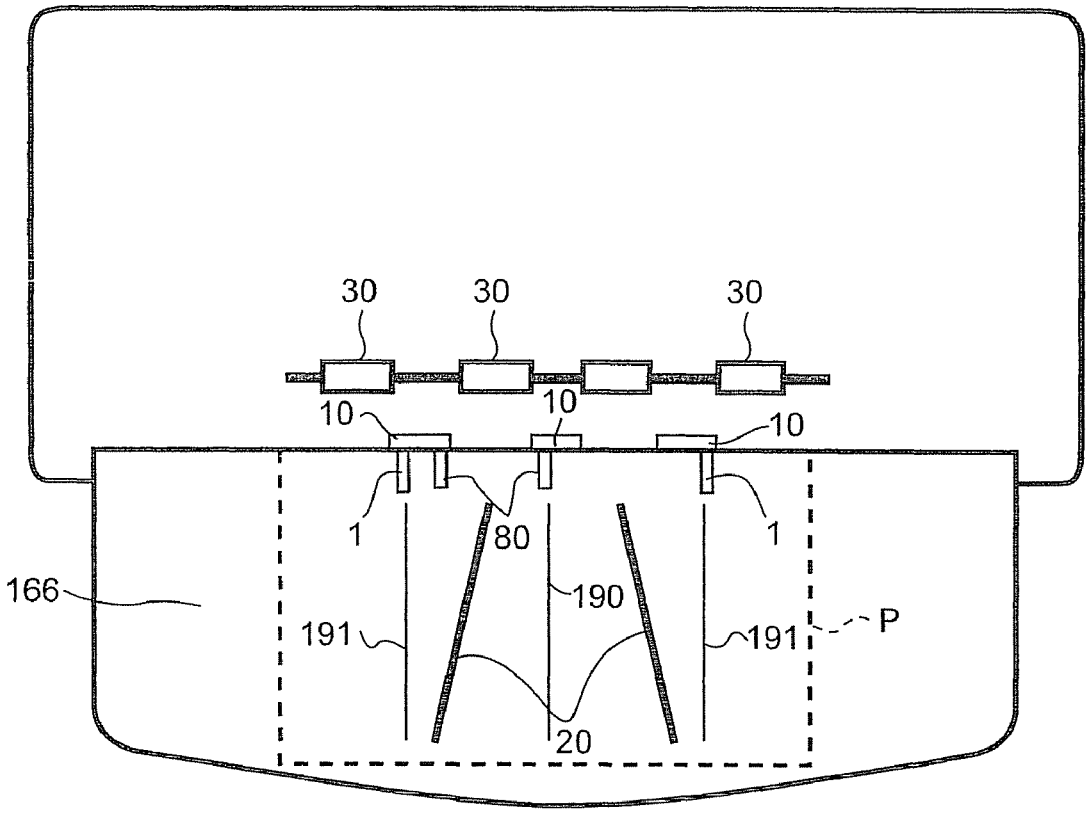
FIG. 12B is a plan view showing the schematic constitution of FIG. 12A relating to the same embodiment which is viewed from above.

Next, the /\-shaped ribs 20 installed on the receiving tray 166 will be explained. FIG. 12A is a cross sectional view showing a part of FIG. 3B. FIG. 12B is a drawing showing the schematic constitution of the port shown in FIG. 12A which is viewed from above.

The apparatus includes the discharge portion (the discharge rollers 30 and conveyer belt 50) for discharging the sheets P in the discharge direction (the black arrow) from the discharge spout 70, the shutter portion 10 as a wall member installed below the discharge spout 70, the receiving tray 166 which has an inclination for receiving the discharged sheets P and permitting the sheets P to slide down toward the shutter portion 10 and moves up along the shutter portion 10, and the ribs 20 as a projection which are extended in the discharge direction from the side of the shutter portion 10 on the receiving tray 166 and support the sheets P so that the end portion of the sheets P on the opposite side of the shutter portion on the receiving tray 166 has a curved portion which is convex upward.

As shown in FIG. 12A, the ribs 20 have a crest in the neighborhood of the end of the receiving tray 166 and are shaped so that the crest is decreased gradually in height toward the shutter portion 10. Therefore, the gradient angle of loaded sheets can be increased without increasing the gradient angle of the receiving tray 166.

When the gradient angle of the tray is excessive, if the movable receiving tray 166 comes to the highest position under the upward movement control, the projected part of the end of the tray is increased than the uppermost part of the sheet post-process apparatus 120, so that a problem arises that the space for the apparatus is increased. By installation of the ribs, the above problem can be avoided and the gradient angle of loaded sheets can be increased.

Further, as shown in FIG. 12B, the paired ribs 20 are installed in the /\shape (or the V shape). The paired ribs 20 are extended so that the interval therebetween is spread gradually in the /\shape from the opposite position of the two discharge rollers 30 for conveying the central part of the sheets at the time of discharge. The ribs 20 are installed almost symmetrically about a straight line 190 extending in the discharge direction of sheets from the center between the two discharge rollers 30. Furthermore, the paired ribs 20 are installed between two straight lines 191 extending in the sheet discharge direction from the two holding members 1. It is preferable that at least one end of each of the paired ribs 20 on the side of the shutter portion 10 is arranged between the holding members 1, that is, between the two straight lines 191.

The sheets P on the receiving tray 166 are supported by the paired ribs 20 at the central part thereof so that the center of gravity thereof is set between the two ribs 20. Therefore, the sheets P, as described later, are formed in a half columnar convex upward (semi-cylindrical) along the straight line 190 and are loaded on the tray. Actually, the paired ribs 20 are formed in the /\shape that as they are separated from the neighborhood of the shutter portion 10, the interval thereof is spread, so that the half columnar shape formed by the sheets P, as it is separated from the neighborhood of the shutter portion 10, is changed to a shape that a half circle is spread in the transverse direction.

One end of each of the paired ribs 20 on the side of the shutter portion 10 is installed so as to be arranged between the two holding members 1. Therefore, during the sheet holding operation by the holding member 1, the curvature of the semi-cylindrical shape of the sheets P formed by the ribs 20 can be promoted.

Figure 15A:
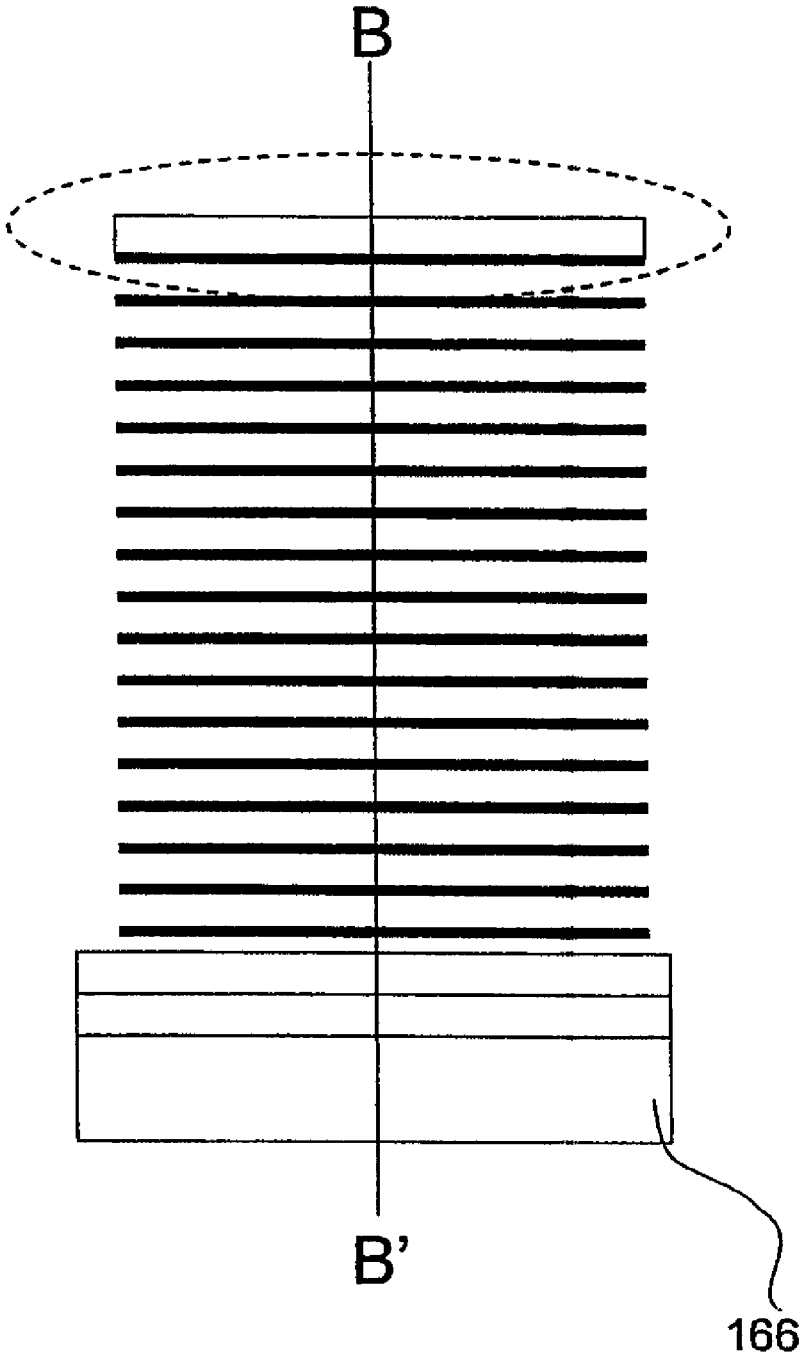
FIG. 15A is a front view showing the schematic constitution of the conventional receiving tray 166, which is viewed from the front, when a large amount of sheets is loaded.
Figure 15B:
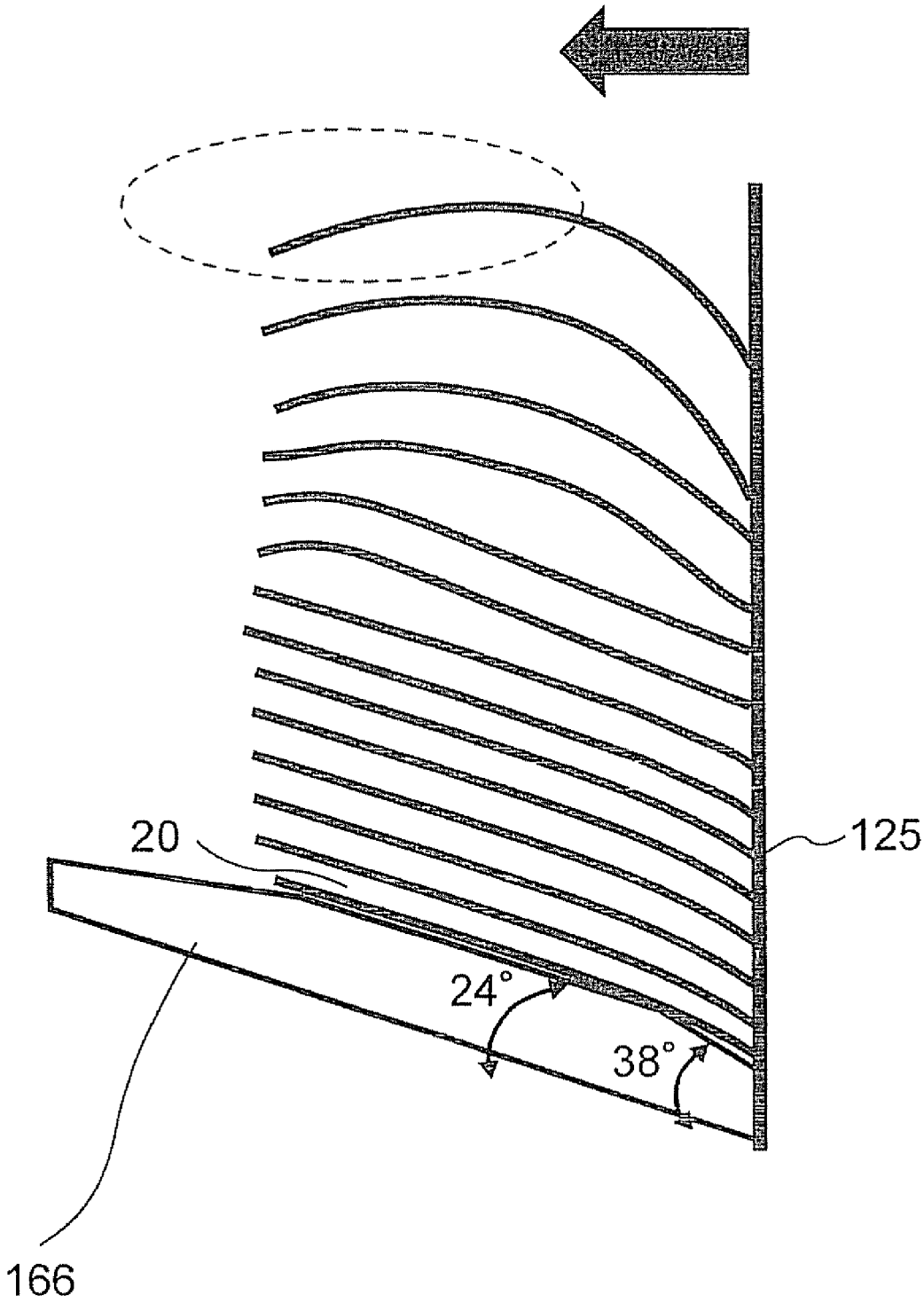
FIG. 15B is a cross sectional view along the line B-B' shown in FIG. 15A.

FIG. 15A is a front view showing the schematic constitution of the conventional receiving tray 166 having no ribs 20, which is viewed from the front, when a large amount of sheets is loaded. FIG. 15B is a cross sectional view along the line B-B' shown in FIG. 15A. The receiving tray 166 has an inclination of 38° of the surface thereof with the horizontal direction on the shutter portion side, which is shaped so as to change to 24° at a predetermined position away from the shutter portion.

The conventional receiving tray 166 has a predetermined upward slope gradient (inclination) to the sheet discharge direction, receives discharged sheets, saves them on the tray, and loads sheets discharged sequentially. The sheets received by the receiving tray 166 strike against a wall face portion 125 of the shutter portion 10 of the first post-process portion 160, thereby are stacked by being aligned.

However, by use of only the aforementioned conventional constitution, when a large amount of sheets is loaded on the receiving tray 166, by the portion enclosed by a dotted line ellipse which is the end portion of the sheet stacked on the upper part, the downward slope portion is formed in the sheet discharge direction. By doing this, a problem arises that the discharged sheets slide down on the downward slope portion, are not saved on the receiving tray 166, and leak out.

Namely, when forming an image in the main body of image forming apparatus 110 or conveying an image in the sheet post-process apparatus 120, a sheet is always processed and conveyed by the roller having the longitudinal direction in the perpendicular direction to the sheet conveying direction. By doing this, particularly, a sheet not sufficiently rigid (stiff) is added with a habit of rolling up (buckling) on axis of the perpendicular direction to the sheet conveying direction. The phenomenon that a sheet is rolled up (buckled) like this is called a curl phenomenon.

Figure 13A:
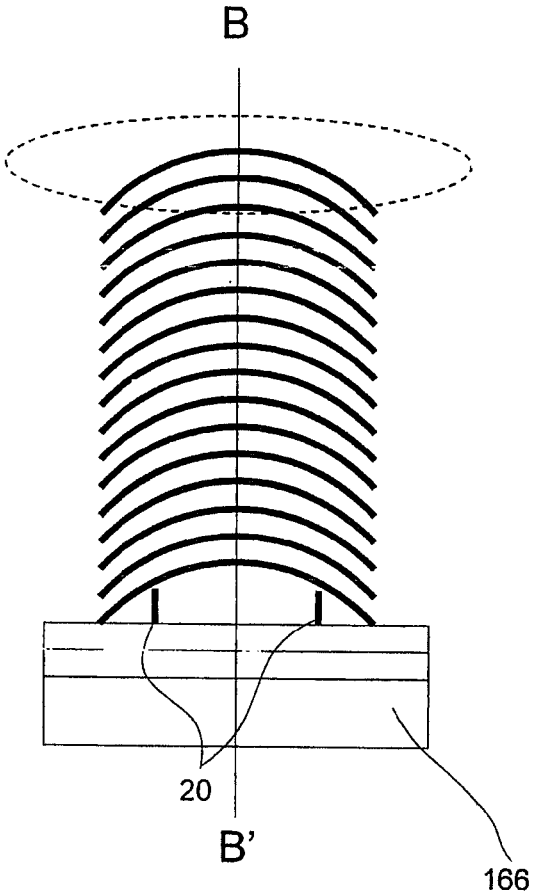
FIG. 13A is a front view showing the schematic constitution of the receiving tray 166 having ribs 20 relating to the same embodiment, which is viewed from the front, when a large amount of sheets is loaded.

FIG. 13A is a front view showing the schematic constitution of the receiving tray 166 having the ribs 20 relating to the first embodiment, which is viewed from the front, when a large amount of sheets is loaded. FIG. 13B is a cross sectional view along the line B-B' shown in FIG. 13A. The receiving tray 166 has an inclination of 38° of the surface thereof with the horizontal direction on the shutter portion side, which is shaped so as to change to 24° at a predetermined position away from the shutter portion.

On the surface of the receiving tray 166, the paired ribs 20 are installed. As shown in FIG. 13B, the ribs 20 have an inclination of 35° with the horizontal direction. As shown in FIG. 13A, sheets are loaded on the tray via the paired ribs 20, so that the sheets are formed and stacked in the arch shape convex upward on axis of the parallel direction with the sheet conveying direction. Namely, at least one part of the end portion of the sheets on the opposite side of the wall face portion 125 has a curved portion convex upward.

By doing this, the curl phenomenon that the stacked sheets are rolled up (buckled) on axis of the perpendicular direction to the sheet conveying direction can be prevented. As shown in FIG. 13B, the sheet section maintains the upward slope inclination and in the portion of the dotted line ellipse shown in the drawing which is the end portion of the sheet stacked on the upper part, the aforementioned downward slope portion can be prevented from being formed. Therefore, the discharged sheets can be prevented from leaking out without being saved on the tray.

Figure 13C:
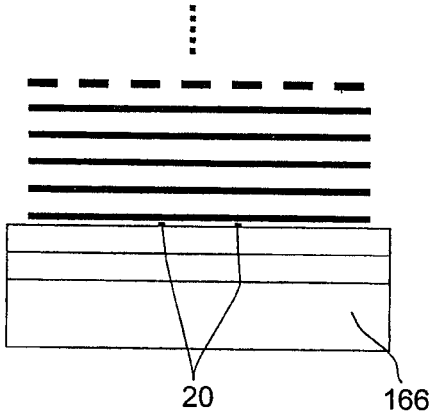
FIG. 13C is a front view along the line C-C' shown in FIG. 13B.
Figure 13D:
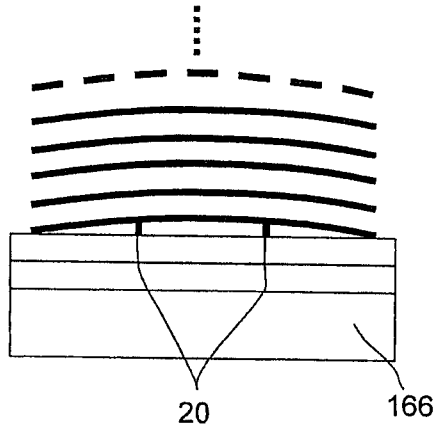
FIG. 13D is a front view along the line D-D' shown in FIG. 13B.
Figure 13B:
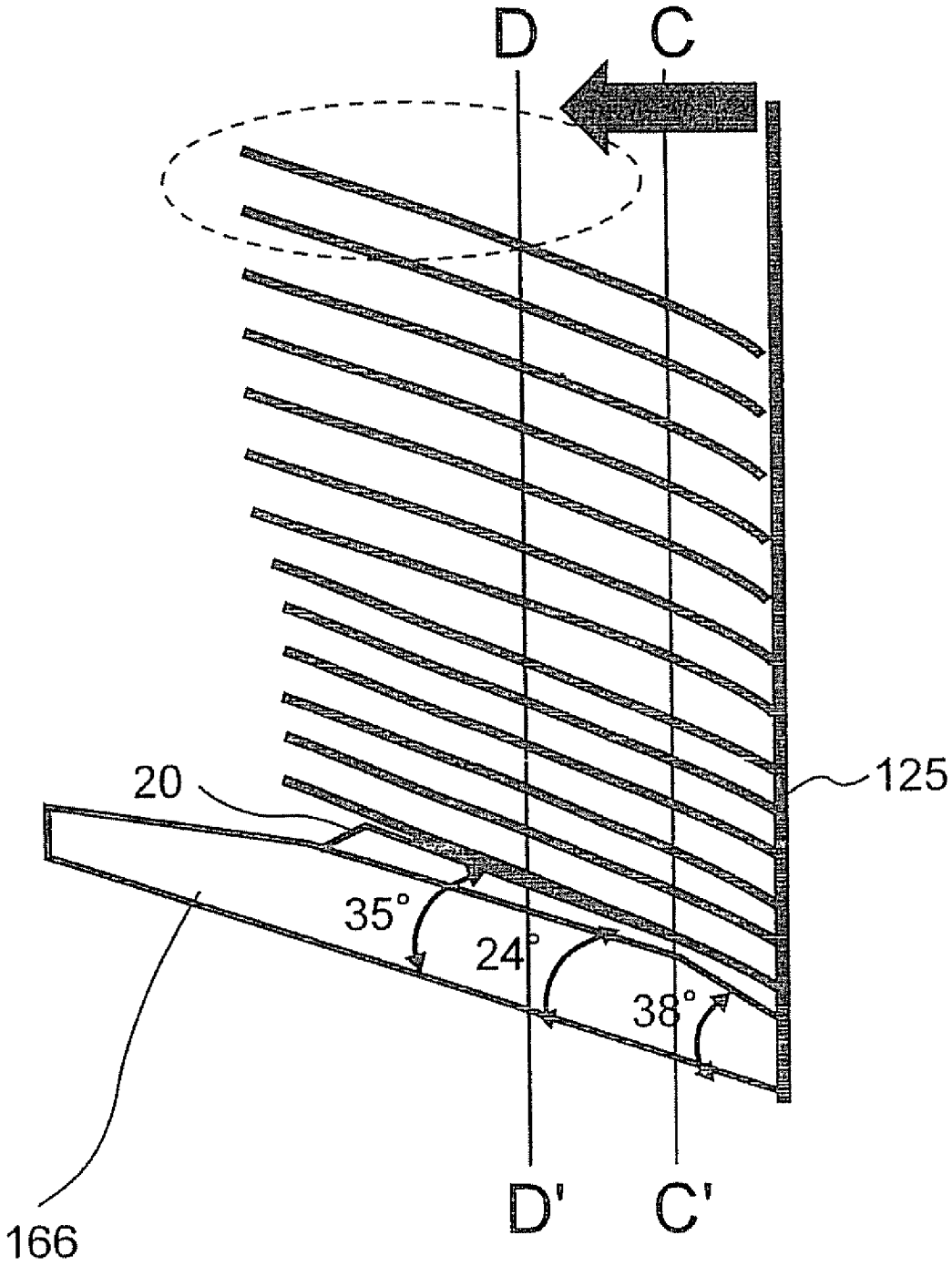
FIG. 13B is a side view along the line B-B' shown in FIG. 13A.

Further, FIG. 13C is a cross sectional view along the line C-C' in the neighborhood of the wall face portion 125 shown in FIG. 13B. FIG. 13D is a cross sectional view along the line D-D' shown in FIG. 13B.

As shown in FIG. 13C, in the start portion of the ribs 20 extended, the ribs have little height. Further, the rib width is narrower than the width shown in FIG. 13A. Therefore, little effect of the ribs 20 can be obtained, so that the cross section shape of the sheet bundle in the neighborhood of the wall face portion 125 is almost flat.

As shown in FIG. 13D, in the middle abdomen of the ribs 20 extended, the rib height is higher than the height shown in FIG. 13C and lower than that shown in FIG. 13A. Further, the rib width is wider than the width shown in FIG. 13C and narrower than that shown in FIG. 13A. Therefore, the effect of the ribs 20 is higher than that in the neighborhood of the wall face portion 125, so that the section of the sheet bundle has an arch shape convex upward. However, compared with FIG. 13A, the ribs 20 have no height, so that the arch shape is shallow.

As shown in FIG. 13A, in the end portion of the ribs 20 extended, the rib height is maximum. Therefore, a deep arch shape can be formed by the ribs 20 and the width of the ribs 20 is wide, so that an arch shape having a large radius of curvature can be obtained.

The sheet bundle loaded on the receiving tray 166 via the ribs 20, assuming the sheet discharge direction (the black arrow) as an end portion, has a shape that the arch shape becomes deeper gradually toward the end portion. Therefore, the neighborhood of the back-end portion of the sheet bundle has at least a flat shape, so that the loaded sheet bundle can be prevented from moving in the horizontal direction (the direction perpendicular to the sheet discharge direction).

In this embodiment, the tray having a shape that the inclination of the surface thereof is changed from 38° to 24° is used for explanation, though for example, a flat tray the inclination of which is not changed from 32° may be used. If there are the ribs 20 installed, the effect explained in this embodiment can be obtained.

Further, in this embodiment, the ribs 20 having a pair of cylindrical projections are explained. However, for example, an integrated member which is spread in the width direction as it is separated from the wall face portion 125 and has a predetermined inclination which is a gradient larger than the inclination of the receiving tray 166 is installed at the central part of the tray, thus the effect explained in this embodiment can be obtained. This member may be formed so as to have a concavity at the central part.

Second Embodiment

Next, the second embodiment will be explained. In the sheet discharge apparatus relating to this embodiment, the basic structure thereof is based on that of the first embodiment. However, in the sheet discharge apparatus relating to this embodiment, the discharge spout for discharging sheets is different, so that the standby position of the movable receiving tray and the height position of the shutter portion are different.

Hereinafter, the ordinary post-process portion of this embodiment will be explained by referring to FIG. 14. Further, for the structure equivalent to or based on the first embodiment, the same numerals are assigned and the detailed explanation thereof will be omitted. The unessential sections of this embodiment are not assigned numerals.

Figure 14A:
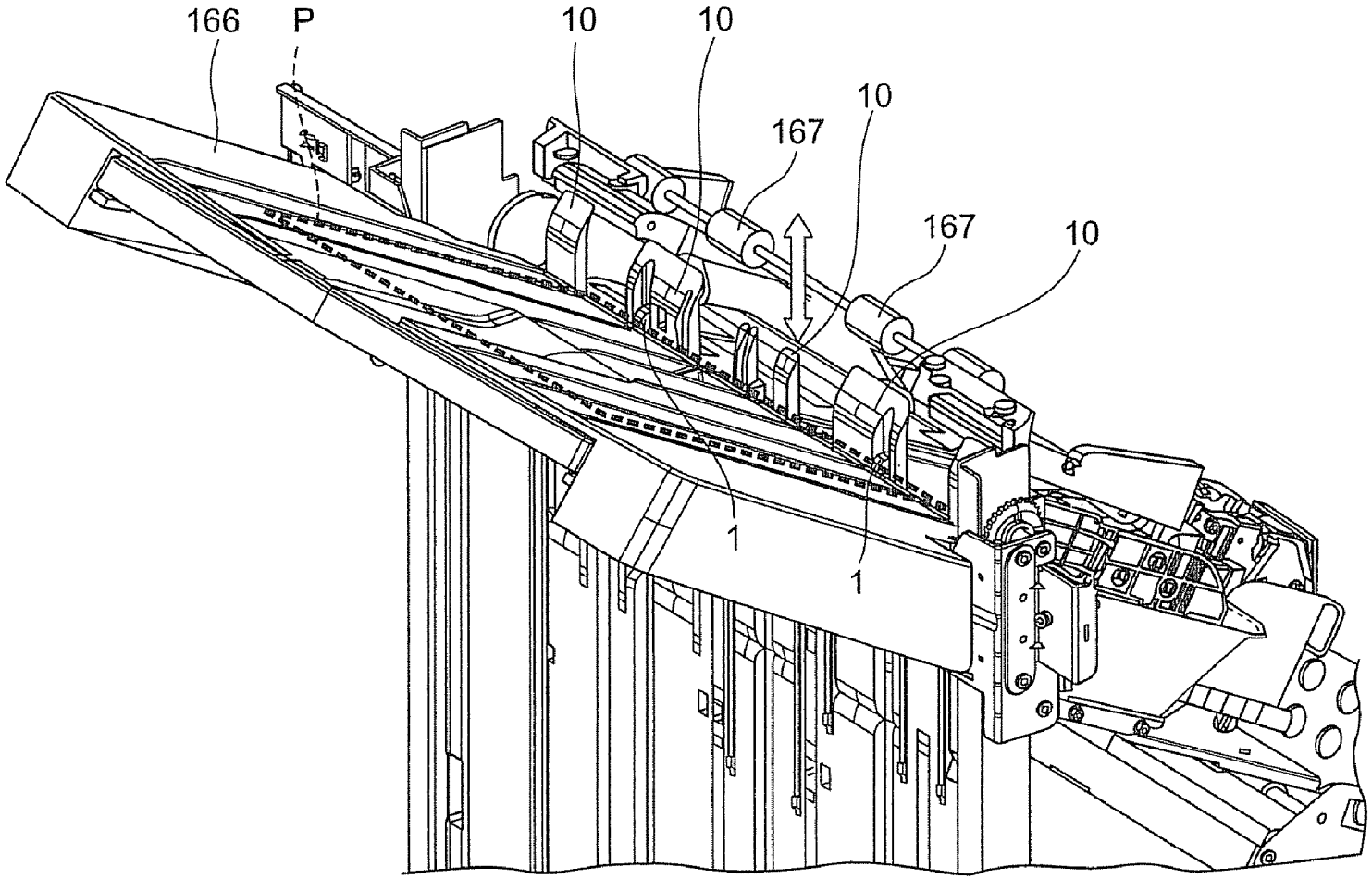
FIG. 14A is a perspective view showing the state that the tray standby position of the receiving tray 166 relating to the second embodiment is high.
Figure 14B:
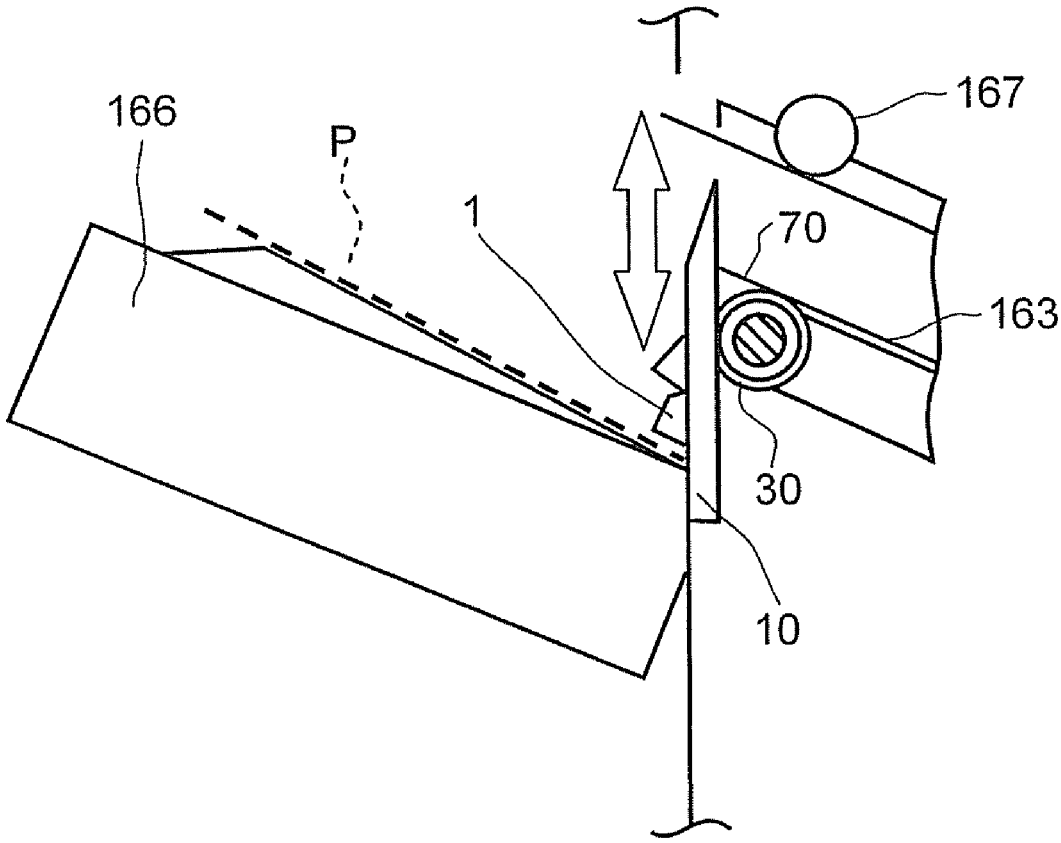
FIG. 14B is a cross sectional view showing the state that the tray standby position of the receiving tray 166 relating to the second embodiment is high.

FIG. 14A is a perspective view showing the state that the tray standby position of the receiving tray 166 is high. FIG. 14B is a cross sectional view showing the schematic constitution when the tray standby position of the receiving tray 166 is high.

When the job contents are different, the receiving tray 166 is controlled in upward movement to the neighborhood of the discharge spout 70 and stands by at the tray standby position for receiving the sheets P to be discharged. At this time, to prevent the sheets P to be discharged to the tray from reverse flow to the discharge spout 70, the shutter portion 10 is controlled in upward movement in correspondence to the upward movement of the receiving tray 166. The shutter portion 10 is composed of a plurality of laminar members arranged at a predetermined interval and the plurality of laminar members move up and down integrally.

FIG. 14 shows the case that the sheets on the standby tray 165 (refer to FIG. 2) are discharged to the receiving tray 166 by the intermediated standby tray roller 167. In this case, in correspondence to the upward movement control of the movable receiving tray 166, up to the position between the tray surface at the tray standby position and the holding member 1 where the sheets can be inserted, the shutter portion 10 is controlled in upward movement. The sheets P received by the receiving tray 166 slide down toward the shutter portion 10 due to the tray gradient, hit on the shutter portion 10, and are aligned. The back-end portion of the sheets P is positioned between the holding member 1 and the tray surface.

As shown in the drawing, the receiving tray 166 does not move up and down, and the shutter portion 10 is controlled in the downward movement, thus the back-end portion of the sheets P is held between the holding member 1 and the tray surface of the receiving tray 166. By doing this, the sheets P are aligned and preserved on the tray, make contact with the sheets to be discharged next, thus can be prevented from misalignment.

As mentioned above, the holding member 1, since the receiving tray 166 is controlled in upward movement or the shutter portion is controlled in downward movement, holds and preserves the sheets P between the receiving tray 166 and itself. Namely, the holding member 1 executes the linear movement so as to relatively approach the receiving tray 166, thereby holds and preserves the sheets P between the receiving tray 166 and itself.

Other Embodiments

The aforementioned embodiments can be, but not limited to, modified as described below.

(a) In the aforementioned embodiments, the coil spring is adopted to press downward the "holding member" is not limited to it and by using the own weight of the holding member, force acting downward for holding sheets on the tray is generated, so that the effect explained in the aforementioned embodiments can be obtained. Further, the coil spring may be an elastic body and for example, a damper may be used.

(b) For example, the receiving tray 166 may be controlled in the upward movement and the shutter portion 10 may be controlled in the downward movement, thus the sheets P may be clamped. Further, the receiving tray 166 may be controlled in the upward movement and the shutter portion 10 may be controlled in the upward movement under the condition that the shutter portion 10 is lower in the upward movement speed than the receiving tray 166, thus the sheets P may be clamped.

What is claimed is:

1. A sheet discharge apparatus comprising:

a discharge portion configured to discharge sheets;

a wall member having a concavity, provided below the discharge portion;

a tray configured to receive the discharged sheets from the discharge portion; and a holding member having a head portion, provided on the wall member to hold the sheets between itself and the tray, the holding member rotating when the sheet hits on the head portion thus at least one part thereof projected from the wall member being stored in the concavity.

2. The sheet discharge apparatus according to claim 1:

the tray having an inclined surface to make the sheets slide down;

the discharge portion discharging the sheets with one end portion of the sheets at the head thereof; and the inclined surface of the tray making the sheets slide down on the other side of the sheets.

3. The sheet discharge apparatus according to claim 1:

the holding member having a holding portion opposite to the surface of the tray and the holding portion is almost parallel with the tray surface.

4. The sheet discharge apparatus according to claim 1:

the holding member being pressed by a coil spring in the opposite direction to the linear movement direction, the lower end of the coil spring being fixed and the upper end of the coil spring being connected to the holding member and pressing downward the holding member.

5. The sheet discharge apparatus according to claim 1 further comprising:

an air gap formed in the wall member;

an opening portion formed at the bottom of the concavity of the wall member and connected to the air gap; and an upper guide pin and a lower guide pin arranged in the linear movement direction of the holding member on a part in the air gap from the opening portion of the holding member, the upper guide pin and the lower guide pin sliding in the air gap, thus the holding member moving linearly.

6. The sheet discharge apparatus according to claim 5:

the air gap having a rotation space of the holding member more than sliding of the second guide pin; and the lower guide pin moving in the direction of separation from the tray in the rotation space of the holding member, thus the holding member rotating.

7. An image forming apparatus comprising:

a sheet storage portion configured to store sheets;

an image forming portion configured to form an image on the sheets conveyed from the sheet storage portion;

a discharge portion configured to discharge the sheets with the image formed from a discharge spout;

a wall member having a concavity, provided below the discharge portion;

a tray configured to receive the discharged sheets from the discharge portion; and a holding member having a head portion, provided on the wall member to hold the sheets between itself and the tray, the holding member rotating when the sheet hits on the head portion thus at least one part thereof projected from the wall member being stored in the concavity;

the tray moving up for the discharge portion; and the holding member, since the tray moves up, approaching relatively to the tray, holding the sheets between itself and the tray, and then since the tray moving up furthermore, moving linearly in the upward movement direction of the tray.

8. The apparatus according to claim 7:

the wall member moving up and down in the directions of approaching and separating from the discharge portion; and the holding member, since the wall member moving down, approaching relatively to the tray, makes contact with the sheets, then since the wall member moving down furthermore, moving linearly in the opposite direction of the downward movement direction of the wall member, and holding the sheets between itself and the tray.

9. The apparatus according to claim 8:

the tray having an inclined surface for making the sheets slide down; and the wall member moving up, thereby preventing the sheets sliding down on the inclined surface of the tray from entering the discharge portion.

10. A sheet discharging method comprising:

discharging sheets from a discharge spout;

receiving the discharged sheets by a tray;

sliding down the received sheets to a wall member having a concavity, provided below the discharge spout; and permitting a holding member having a head portion, provided on the wall member and permitting the holding member and the tray surface to hold the sheets therebetween when the head portion is pressurized, at least one part of the holding member is stored in the concavity;

the tray moving up for the discharge portion; and the holding member, since the tray moving up, approaching relatively to the tray, holding the sheets between itself and the tray, and then since the tray moving up furthermore, moving linearly in the upward movement direction of the tray.

11. The method according to claim 10, wherein:

the wall member moving up and down in the directions of approaching and separating from the discharge portion; and the holding member, since the wall member moving down, approaching relatively to the tray, making contact with the sheets, then since the wall member moving down furthermore, moving linearly in the opposite direction of the downward movement direction of the wall member, and holding the sheets between itself and the tray.

12. The method according to claim 11:

the tray having an inclined surface to make the sheets slide down; and the wall member moving up, thereby preventing the sheets sliding down on the inclined surface of the tray from entering the discharge portion.

* * * * *